US006745962B2

(12) United States Patent
Reed et al.

(10) Patent No.: US 6,745,962 B2
(45) Date of Patent: Jun. 8, 2004

(54) SMALL-SCALE MILL AND METHOD THEREOF

(75) Inventors: Robert Gary Reed, Birdsboro, PA (US); David A. Czekai, Spring City, PA (US); Henry William Bosch, Bryn Mawr, PA (US); Niels-Peter Moesgaard Ryde, Malvern, PA (US)

(73) Assignee: Elan Pharma International Limited, Shannon (IE)

( * ) Notice: Subject to any disclaimer, the term of this patent is extended or adjusted under 35 U.S.C. 154(b) by 0 days.

(21) Appl. No.: 10/037,566

(22) Filed: Oct. 19, 2001

(65) Prior Publication Data

US 2002/0145062 A1 Oct. 10, 2002

Related U.S. Application Data

(62) Division of application No. 09/583,893, filed on May 31, 2000, now Pat. No. 6,431,478.

(60) Provisional application No. 60/137,142, filed on Jun. 1, 1999.

(51) Int. Cl.[7] ..... B02C 17/16

(52) U.S. Cl. ..... 241/21; 241/23

(58) Field of Search ..... 241/23, 65, 30, 241/21, 172

(56) References Cited

U.S. PATENT DOCUMENTS

| | | | |
|---|---|---|---|
| 4,848,676 | A | 7/1989 | Stehr |
| 5,133,506 | A | 7/1992 | Bogen |
| 5,145,684 | A | 9/1992 | Liversidge et al. |
| 5,183,215 | A | 2/1993 | Getzmann |
| 5,464,163 | A | 11/1995 | Zoz |
| 5,518,187 | A | 5/1996 | Bruno et al. |
| 5,593,097 | A | 1/1997 | Corbin |
| 5,718,388 | A | 2/1998 | Czekai et al. |
| 5,797,550 | A | 8/1998 | Woodall et al. |
| 5,862,999 | A | 1/1999 | Czekai et al. |

FOREIGN PATENT DOCUMENTS

| | | |
|---|---|---|
| EP | 0483808 A1 | 5/1992 |
| EP | 0686428 A1 | 12/1995 |

*Primary Examiner*—Mark Rosenbaum
(74) *Attorney, Agent, or Firm*—Foley & Lardner LLP

(57) ABSTRACT

A small-scale or micro media-mill and a method of milling materials or products, especially pharmaceutical products, use a dispersion containing attrition milling media and the product to be milled. The milling media can be polymeric, formed of polystyrene or cross-linked polystyrene, having a nominal diameter of no greater than 500 microns. Other sizes include 200 microns and 50 microns and a mixture of these sizes. The mill has a relatively small vessel having an opening, an agitator, a coupling and a motor. The agitator can have a rotor and a shaft extending therefrom. The rotor can be cylindrical or have other configurations, and can have tapered end surfaces. The coupling can close the vessel opening, or attaching the coupling to the motor can close the opening. The coupling has an opening through which the rotor shaft extends into the motor. A sealing mechanism, such as a mechanical or lip seals the shaft while permitting the rotor shaft to rotate. The vessel can contain one or more ports for circulating the dispersion, where milling can be made in batches or recirculated through the milling chamber. The media can be retained in the vessel or recirculated along with the process fluid. The rotor is dimensioned so that its outer periphery is spaced with a small gap from an inner surface of the vessel. The vessel also can have a way of cooling the dispersion.

75 Claims, 12 Drawing Sheets

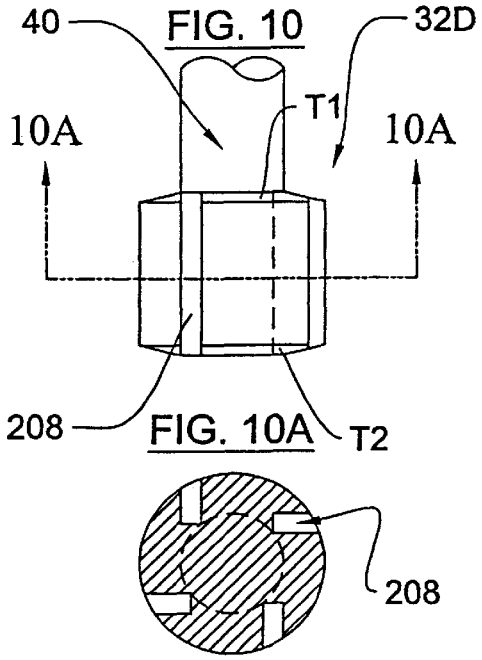
FIG. 10
40
32D
T1
10A
10A
208
T2
FIG. 10A
208
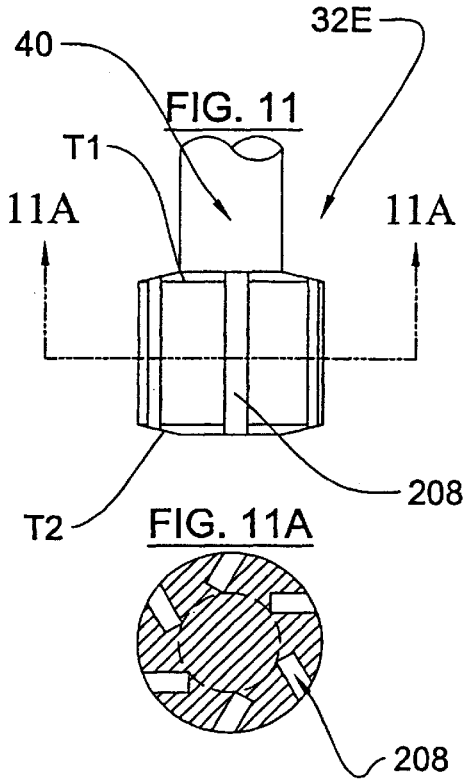
40
32E
FIG. 11
T1
11A
11A
208
T2
FIG. 11A
208
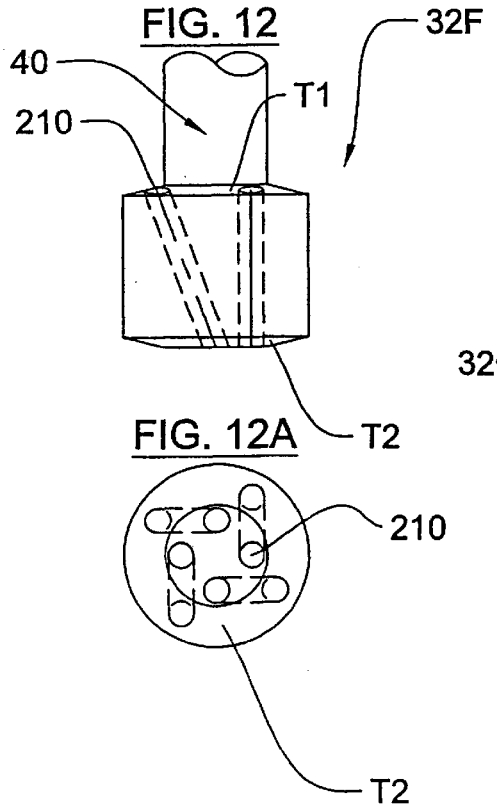
FIG. 12
32F
40
T1
210
T2
FIG. 12A
210
T2
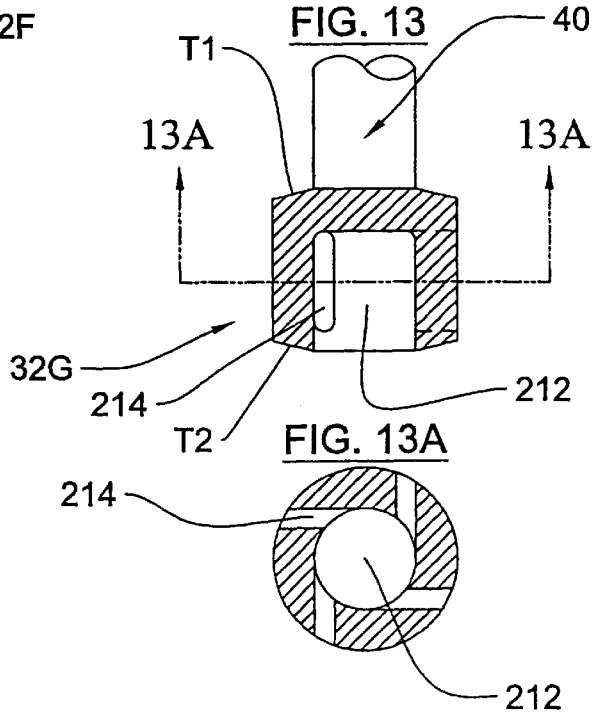
FIG. 13
40
T1
13A
13A
32G
214
212
T2
FIG. 13A
214
212

SMALL-SCALE MILL AND METHOD THEREOF

RELATED APPLICATIONS

This is a divisional application of Application Ser. No. 09/583,893, filed May 31, 2000 now U.S. Pat. No. 6,431,478, entitled SMALL-SCALE MILL AND METHOD THEREOF, which is based on Provisional application No. 60/137,142, filed Jun. 1, 1999 and all of whose entire disclosures are incorporated by reference herein.

BACKGROUND

Wet media mills, such as the ones described in U.S. Pat. No. 5,797,550 issued to Woodall, et al, and U.S. Pat. No. 4,848,676 issued to Stehr, are generally used to mill or grind relatively large quantities of materials. These rather large media mills are not generally suitable for grinding small or minute quantities. U.S. Pat. No. 5,593,097 issued to Corbin recognizes the need for milling small quantities, as small as 0.25 grams, to a size less than 0.5 micron to about 0.05 micron in terms of average diameter in about 60 minutes.

The media mill described in the Corbin patent comprises a vertically oriented open top vessel, a vertically extending agitator with pegs, a motor for rotating the agitator, and a controller for controlling the rotational speed. The vessel is a cylindrical centrifuge or test tube formed of a glass, plastic, stainless steel, or other suitable material having an inner diameter of between 10 to 20 mm. The media suitable is described as any non-contaminating, wear resistant material, sized between about 0.17 mm to 1 mm in diameter.

The particulates to be ground and the grinding media are suspended in a dispersion and poured into the vessel. The agitator, with the peg end inserted in the vessel, is spun. The Corbin patent also discloses that the pegs should extend to within between about 1–3 mm of the sides of the vessel to provide the milling desired in the shortest possible time without damaging the materials and producing excessive heat. To avoid splattering created by vortexing of the material during mixing, the top peg of the mixer is positioned even with the top of the dispersion. No seal or cover is deemed needed during mixing or agitation if this practice is followed.

The Corbin patent also discloses that its micro media can be useful for forming medicinal compounds, food additives, catalysts, pigments, and scents. Medicinal or pharmaceutical compounds can be expensive and require much experimentation, with different sizes and quantities. The Corbin patent discloses that the preferred media for medicinal compounds are zirconium oxide and glass. Moreover, pharmaceutical compounds are often heat sensitive, and thus must be maintained at certain temperatures. In this respect, the Corbin patent discloses using a temperature control bath around the vessel.

In the media mill of the type described in the Corbin patent, even if the vessel is filled to the top peg, however, the rotating agitator in the dispersion creates a vortex, which undesirably draws air into the dispersion and foams the dispersion. Moreover, the open top configuration draws in contamination, making the mill unsuitable for pharmaceutical products. The temperature-controlled bath could spill into the open top container and further contaminate the product.

There is a need for a micro or small-scale media mill that avoids these problems. The present invention is believed to meet this need.

SUMMARY

The present invention relates to a small-scale or micro media-mill and a method of milling materials, such as pharmaceutical products. The present small-scale mill, which can be vertically or horizontally oriented, can use a dispersion containing attrition milling media and the product to be milled. The milling media can be polymeric type, such as formed of polystyrene or cross-linked polystyrene having a nominal diameter of no greater than 500 microns. Other sizes include 200 microns and 50 microns and a mixture of these sizes.

In one embodiment, the mill has a relatively small vessel having an opening, an agitator, and a coupling, and a rotatable shaft mounted for rotation about a shaft mount. The agitator is dimensioned to be inserted in the vessel through the opening. Specifically, the agitator can have a rotor and a rotor shaft extending from the rotor. The rotor shaft is connected to the rotatable shaft. The rotor is dimensioned to be inserted in the vessel with a small gap formed between an outer rotating surface of the rotor and an internal surface of the vessel. The coupling detachably connects the vessel to the shaft mount. The coupling has an opening through which a portion of the agitator, such as the rotor shaft, extends. The shaft mount seals the vessel opening to seal the dispersion in the vessel. A seal can be provided to seal the portion of the agitator or the rotor shaft while permitting the agitator to rotate. The rotatable shaft can be driven by a motor or can be a motor shaft of a motor, preferably a variable speed motor capable of 6000 RPM.

In one embodiment, the coupling can have a threaded portion for detachably mounting to the shaft mount and a flange portion for detachably coupling to the vessel. In another embodiment, the coupling is integrally formed with the vessel and has a threaded portion for detachably mounting to the shaft mount.

The mill can include a cooling system connected to the vessel. In one embodiment, the cooling system can comprise a water jacket. Specifically, the vessel comprises a cylindrical inner vessel and an outer vessel spaced from and surrounding the inner vessel. The inner and outer vessels form a chamber therebetween. The chamber can be vessel shaped or annular. A flange connects the upper ends of the inner and outer vessel. The outer vessel (jacket) has at least first and second passages that communicate with the chamber. The cooling system comprises the outer vessel with the first and second passages, which is adapted to circulate cooling fluid.

In an alternative embodiment, the vessel can comprise an inner cylindrical wall having a bottom and an open top and an outer cylindrical wall spaced from and surrounding the inner vessel. The inner and outer cylindrical walls are connected together so that an annular chamber is formed therebetween. At least the first and second passages are formed at the outer cylindrical wall and communicate with the chamber to pass coolant. The bottom extends radially and covers the bottom end of the outer cylindrical wall. The bottom can have an aperture that allows samples of the dispersion to be withdrawn. A valve can close the aperture. Alternatively, the bottom can have an observation window for observing the dispersion.

In another embodiment, the vessel can include at least one port through which the dispersion is filled. The vessel includes at least two ports through which the dispersion is circulated. In this respect, the cooling system comprises the ports on the vessel for circulating the dispersion. The vessel can be horizontally oriented.

The rotor can be cylindrical, and can have tapered end surfaces. In one embodiment, the rotor is dimensioned so that its outer periphery is spaced no larger than 3 mm away from an inner surface of the vessel, particularly when the dispersion contains attrition media having a nominal size of no larger than 500 microns. The spacing or the gap is preferably no larger than 1 mm, particularly when the dispersion contains attrition media having a nominal size of no larger than 200 microns.

In another embodiment, the cylindrical rotor can have a cavity and a plurality of slots that extend between an inner surface of the cavity and an outer surface of the cylindrical rotor. In another embodiment, the cylindrical rotor can have a plurality of channels extending to an outer surface of the cylindrical rotor. In another embodiment, the cylindrical rotor can have a plurality of passageways extending between the tapered end surfaces of the cylindrical rotor.

One method according to the present invention comprises providing a dispersion containing a non-soluble product to be milled and attrition milling media having a nominal size of no greater than 500 microns; inserting the dispersion into a cylindrical vessel; providing an agitator and a coupling that closes the vessel, the coupling having an opening through which a portion of the agitator extends, the agitator comprising a cylindrical rotor and a shaft extending therefrom, wherein the cylindrical rotor is dimensioned so that an outer periphery is no greater than 3 mm away from an inner surface of the cylindrical wall; inserting an agitator into cylindrical vessel and sealingly closing the coupling, wherein the amount of dispersion inserted into the vessel is so that the dispersion eliminates substantially all of the air in the vessel when the agitator is fully inserted into the vessel; and rotating the agitator for a predetermined period.

Another method according to the present invention comprises providing a dispersion containing a non-soluble product to be milled and attrition milling media having a nominal size of no greater than 500 microns; providing an agitator having a cylindrical rotor and shaft extending therefrom; inserting the agitator in a horizontally oriented cylindrical vessel and sealing the cylindrical vessel, the cylindrical rotor being dimensioned to provide a gap of no greater than 3 mm between an outer surface of the rotor and an inner surface of the vessel; providing at least one port through the cylindrical vessel and maintaining the port at a highest point of the horizontally oriented cylindrical vessel; filling the cylindrical vessel with the dispersion until the dispersion drives out substantially all of the air in the vessel; and rotating the agitator for a predetermined period.

The method further includes cooling the vessel by jacketing the vessel and flowing water between the jacket and the vessel. Another method comprises externally circulating the dispersion through a plurality of ports formed through the horizontally oriented vessel to thereby cool the dispersion or refresh the dispersion.

BRIEF DESCRIPTION OF THE DRAWINGS

These and other features, aspects, and advantages of the present invention will become more apparent from the following description, appended claims, and accompanying exemplary embodiments shown in the drawings.

FIGS. 7–13D illustrate various agitator configurations that can be used with the media mill of FIGS. 1–4.

DETAILED DESCRIPTION

Although references are made below to directions in describing the structure, they are made relative to the drawings (as normally viewed) for convenience. The directions, such as top, bottom, upper, lower, etc., are not intended to be taken literally or limit the present invention.

A small-scale mill 1, 1A, 2 (FIGS. 1–4) according to the present invention is designed to mill relatively small amounts of dispersion to a size ranging from microns to nanometers in a relatively short time, i.e., a few hours or less, using attrition milling media, such as polymer type, e.g., cross linked polystyrene media, having nominal size no greater than about 500 microns (0.5 mm) to about 50 microns or mixtures of the sizes ranging between them. The performance of the present scale mill is designed to provide the results comparable to the DYNO-MILL and the NETZSCH ZETA mills. The mill 1, 1A, 2 according to the present invention can have a provision for cooling the dispersion, which allows increased agitator tip speed without overheating, to increase its efficiency and allow milling of heat sensitive pharmaceutical products.

Figure 5:
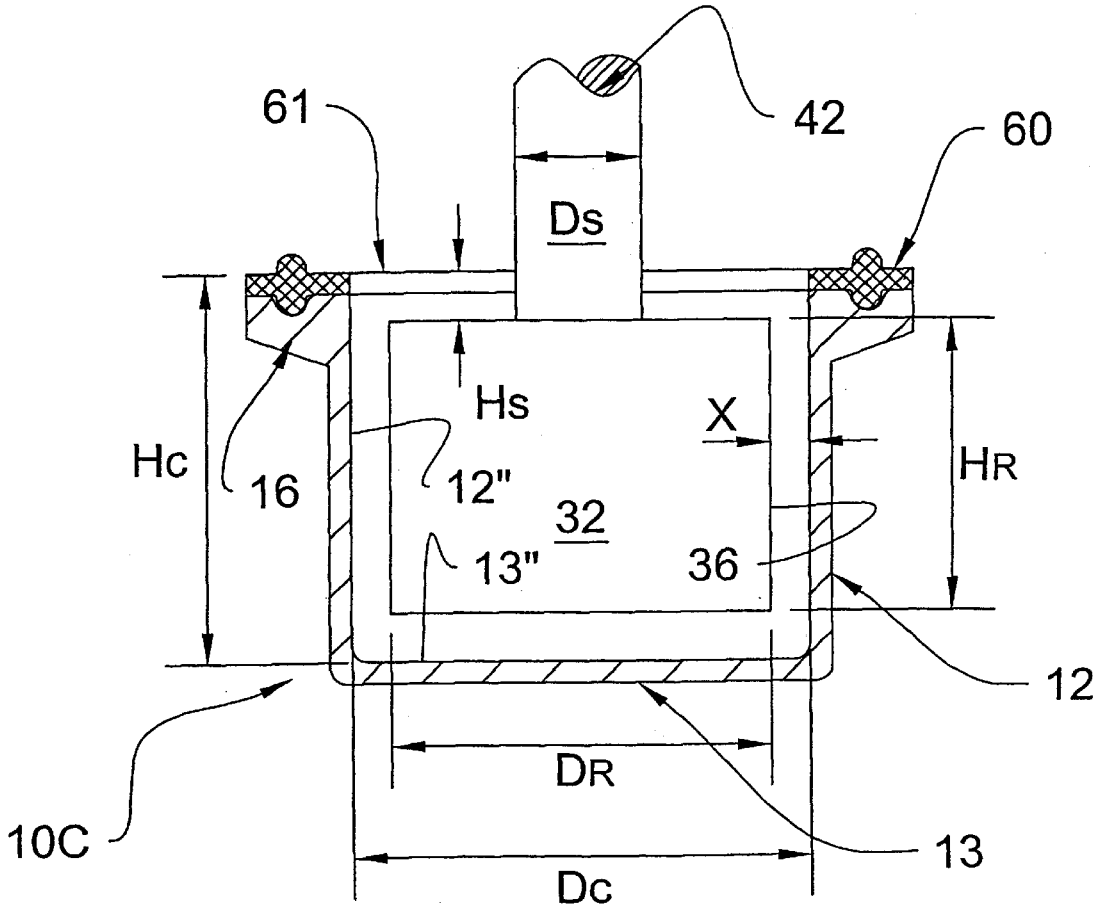
FIG. 5 illustrates another embodiment of an agitator and another embodiment of a vessel that can be used with the media mill of FIGS. 1–4.
Figure 6:
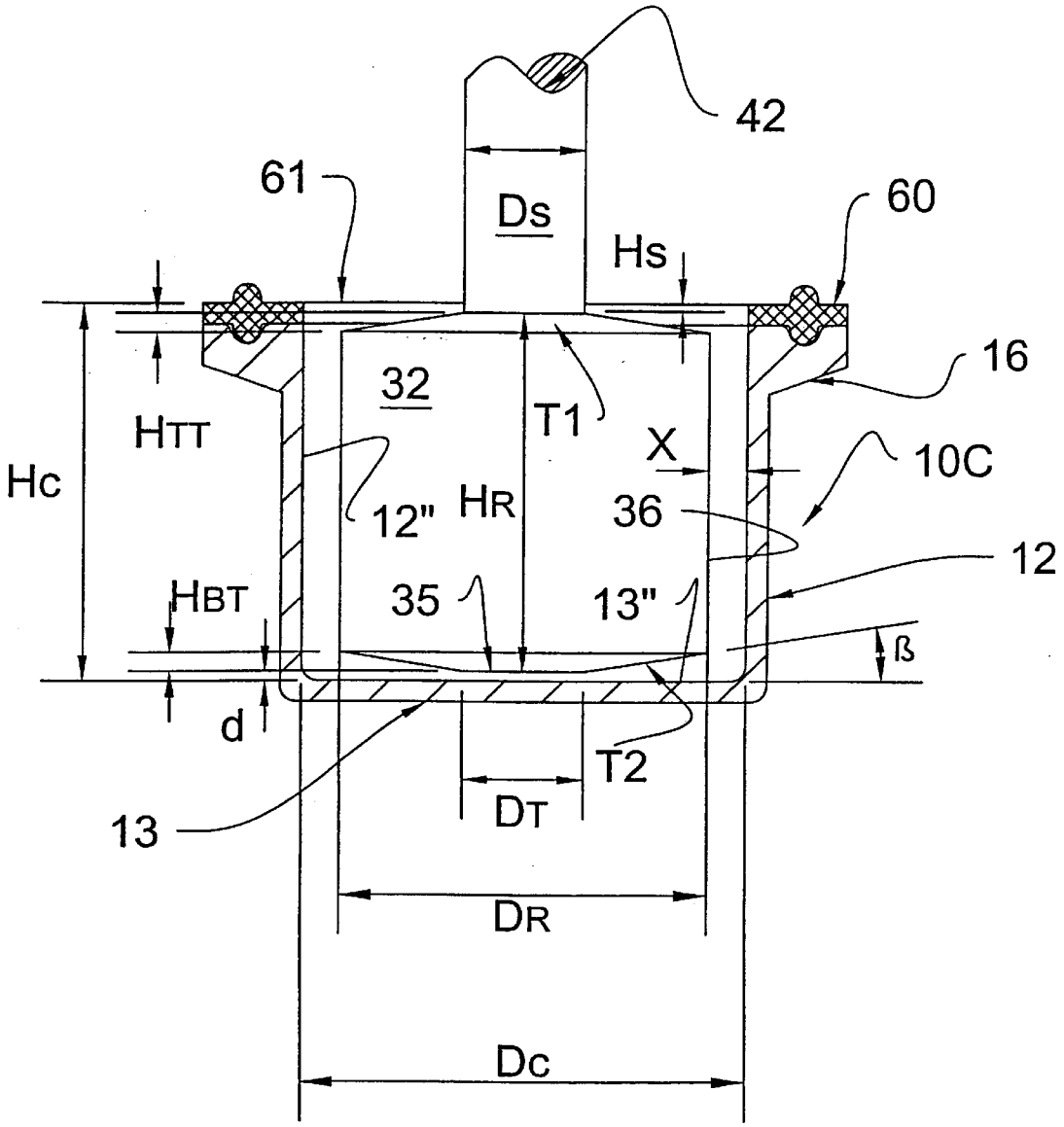
FIG. 6 illustrates the agitator of the type illustrated in the embodiments of FIGS. 1–4.

A vertically oriented mills 1, 1A is exemplified in FIGS. 1–3A. The mill 1, 1A generally comprises a container or vessel 10, 10A, 10B, 10C, an agitator or mixer 30, a coupling 50, and a rotatable journaled shaft 120, which can be that of a motor 100. The vessel 10, 10A, 10B, 10C has a substantially cylindrical milling chamber and can be single walled 10C, as shown in FIGS. 5 and 6, or jacketed (double-walled) 10, 10A, 10B, as shown in FIGS. 1–3A, to allow water cooling. The agitator 30, which comprises a rotor 32 and a shaft 40 extending from one end of the rotor 32, is preferably a single piece to ease cleaning, and is adapted to be connected to a conventional electric motor 100, which preferably is capable of rotating up to 6000 RPM. A conventional motor controller 101 (FIGS. 1, 3, 4), such as SERVODYNE Mixer Controller available from Cole-Parmer Instrument Co. of Vernon Hills, Ill., can control the motor speed and duration. The coupling 50 is mounted to the motor 100 and is coupled to the vessel 10 using a sanitary fitting and a clamp C (shown in phantom in FIG. 3) to seal the vessel 10, 10A, 10B, 10C.

Figure 1:
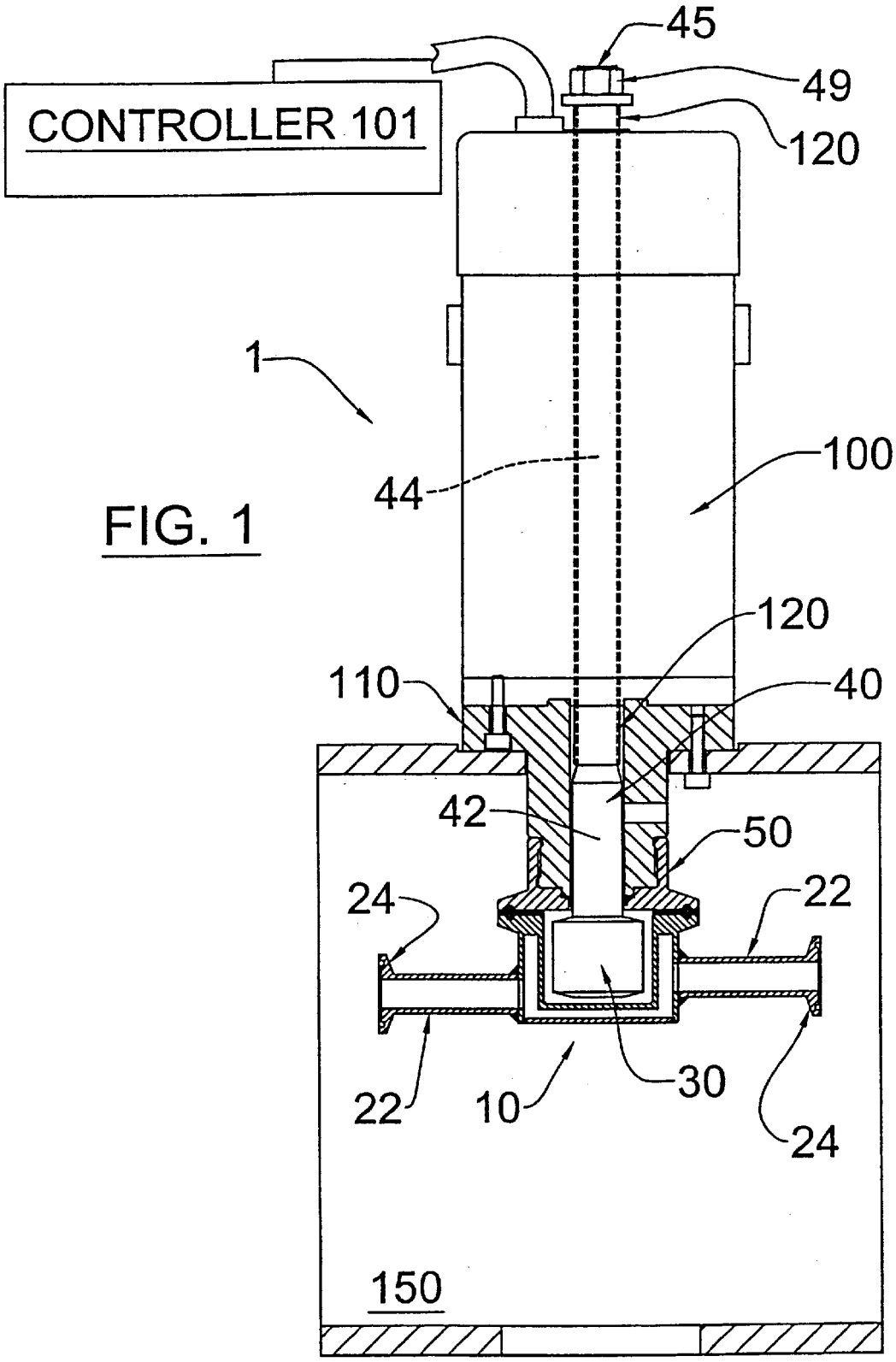
FIG. 1 illustrates a small-scale or micro-media mill according to one embodiment of the present invention.
Figure 1A:
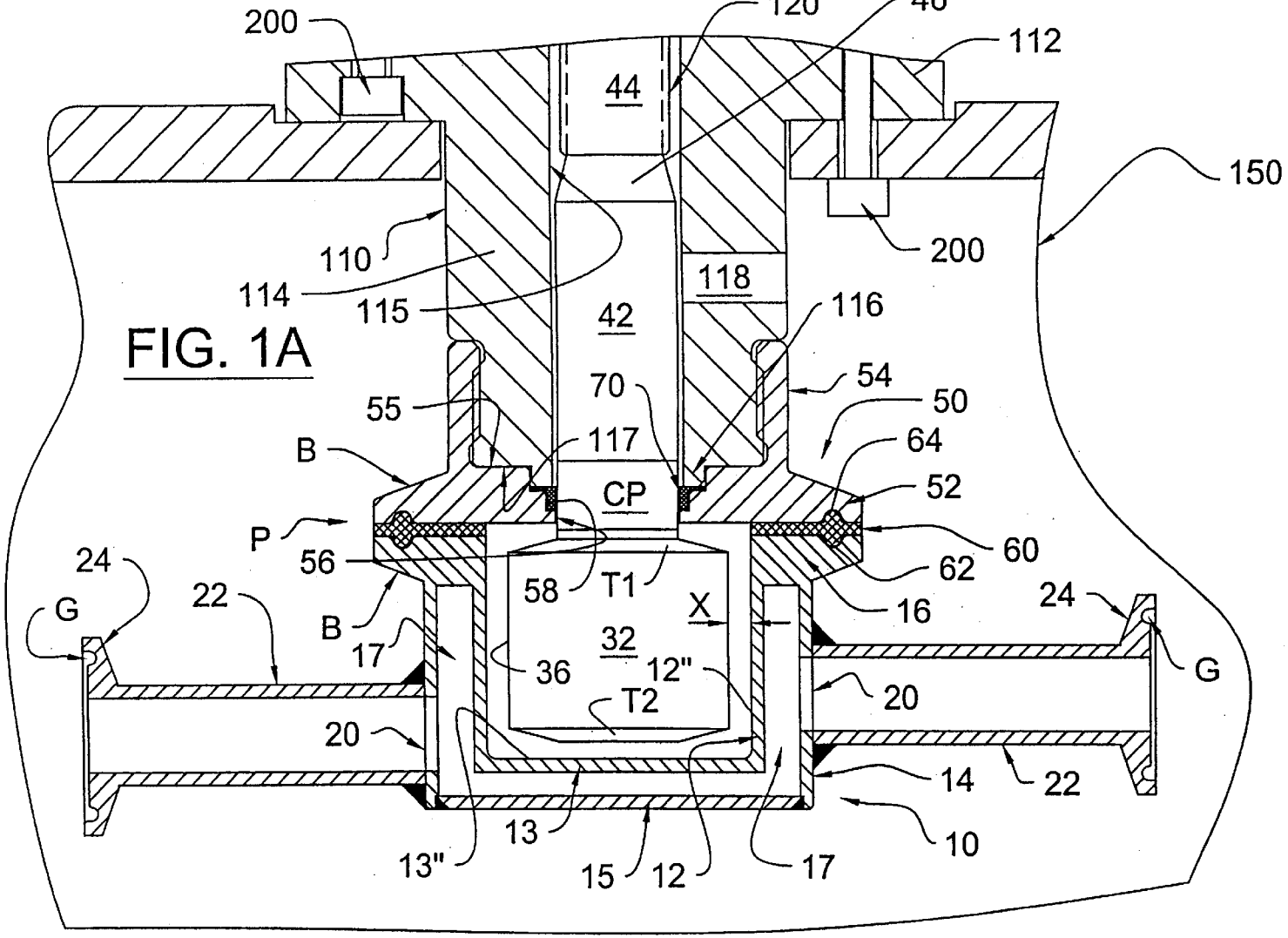
FIG. 1A illustrates an enlarged detailed view of the mill shown in FIG. 1.

Referring to FIG. 1A, the vessel 10 in this embodiment is double walled or jacketed to circulate a coolant. Specifically, the vessel 10 comprises an inner cylindrical wall 12 and an outer cylindrical wall 14 spaced from and concentric with the inner cylindrical wall 12. The outer wall 14, however, need not be cylindrical or concentric relative to the inner wall 12. It can have any configuration that allows water circulation to the inner cylindrical wall 12. An annular mounting flange 16 holds together top end of the inner and outer cylindrical walls 12, 14. The inner cylindrical wall 12 has a bottom wall 13 enclosing its bottom end to form an inner vessel (12, 13). The outer cylindrical wall 14 also has a bottom wall 15 enclosing its bottom end and spaced from the bottom wall 13 to form an outer vessel (14, 15). The outer vessel (14, 15) is spaced from the inner vessel (12, 13) and forms a vessel shaped chamber 17 that can be filled with water and circulated to cool the dispersion during milling.

The outer cylindrical wall 14 has two openings 20, preferably positioned diametrically opposite to each other and a pair of coolant connectors 22 aligned with the openings 20. Either of these connectors 22 can serve as a coolant inlet or outlet. These connectors 22 can extend substantially radially outwardly. The free end of each connector can have a sanitary fitting, which includes an annular mounting flange 24 and a complementary fitting (essentially mirror image thereof—not shown), adapted to be clamped with, for example, a TRI-CLAMP available from Tri-Clover Inc. of Kenosha, Wis. These mounting flanges 24 are configured substantially similar to the mounting flanges 16, 52 connecting the vessel 10, 10A, 10B, 10C to the motor 100. All of these mounting flanges 16, 24, 52 can be adapted for a TRI-CLAMP, as described below. Each of these flanges 16, 24, 52 has an annular groove G for seating an annular gasket 60 and a beveled or tapered surface B. The mounting flanges and the gasket 60, which is FDA approved, adapted for the TRI-CLAMP are also available from Tri-Clover Inc.

Figure 2:
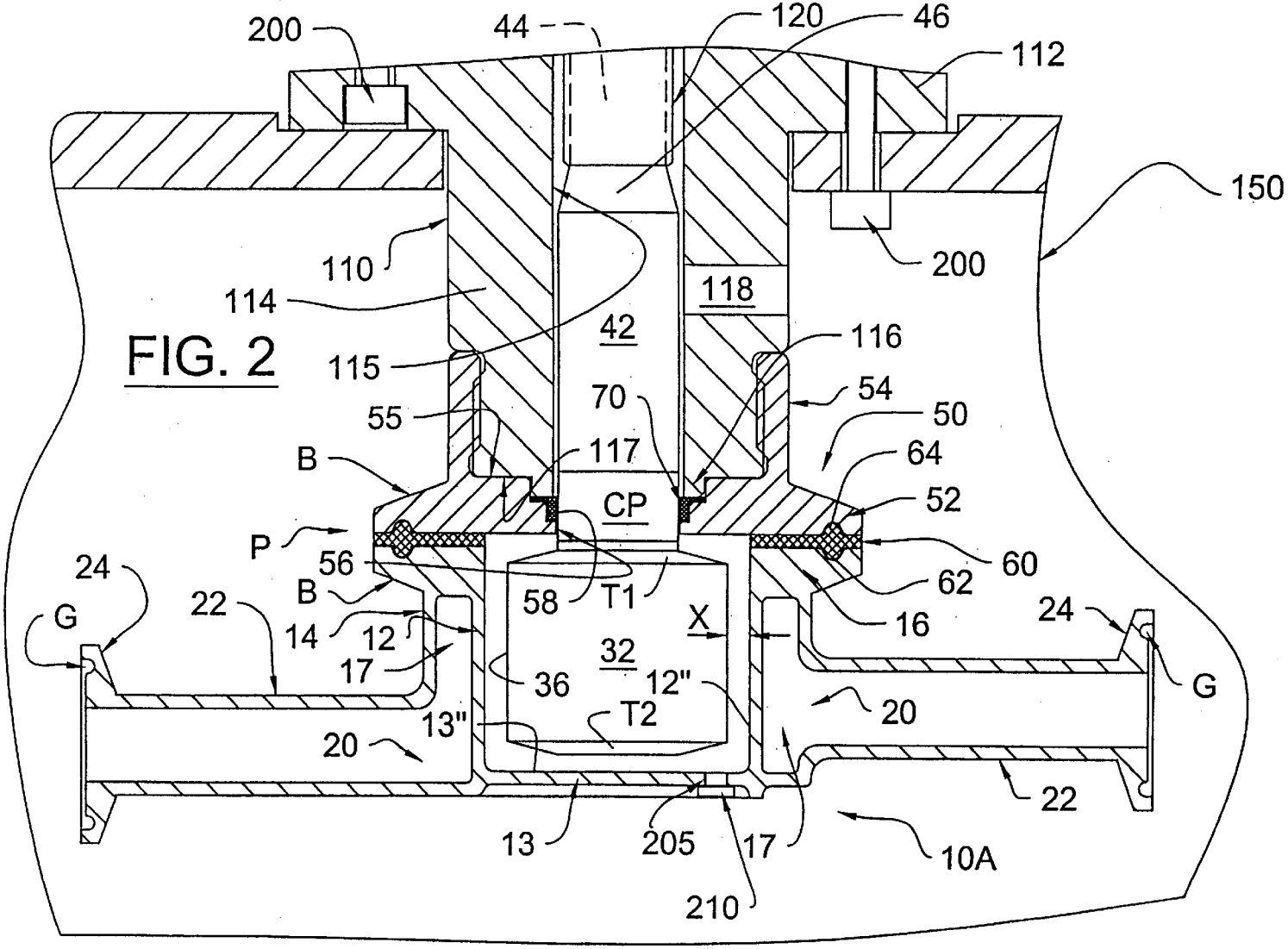
FIG. 2 illustrates the media mill of FIG. 1, but with a different vessel.

FIG. 2 shows another embodiment of the double walled vessel 10A, which is substantially similar to that shown in FIGS. 1 and 1A. The difference is that the bottom wall 13 of the inner cylindrical wall 12 in FIG. 2 is exposed. In other words, the alternative vessel 10A of FIG. 2 has no outer bottom wall 15 of FIG. 1A. The alternative vessel 10A has its bottom wall 13 extending radially outwardly to the outer cylindrical wall 14. The chamber 17 is annular instead of being vessel shaped (FIG. 2). The bottom wall 13 can have a heat sink or a Peltier coolant (not shown) attached. The bottom wall 13 also can have an observation window or an opening 205, which can be sealed or can have a valve 210 that vents excess pressure build up and/or allows a sample withdrawal. This way, minute amounts of dispersion can be taken out and examined without having to take off the coupling 50. Alternatively, the opening can be sealed using a self-sealing resilient material that permits insertion of a syringe for withdrawing samples. The window 205 can have a small chamber extending outwardly from the bottom (not shown). This chamber can hold a small amount of dispersion so that it can be viewed through an observation device. This chamber can be configured so that the dispersion is constantly circulated, such as placing the window 205 in a location where the dispersion is constantly moving.

Figure 3:
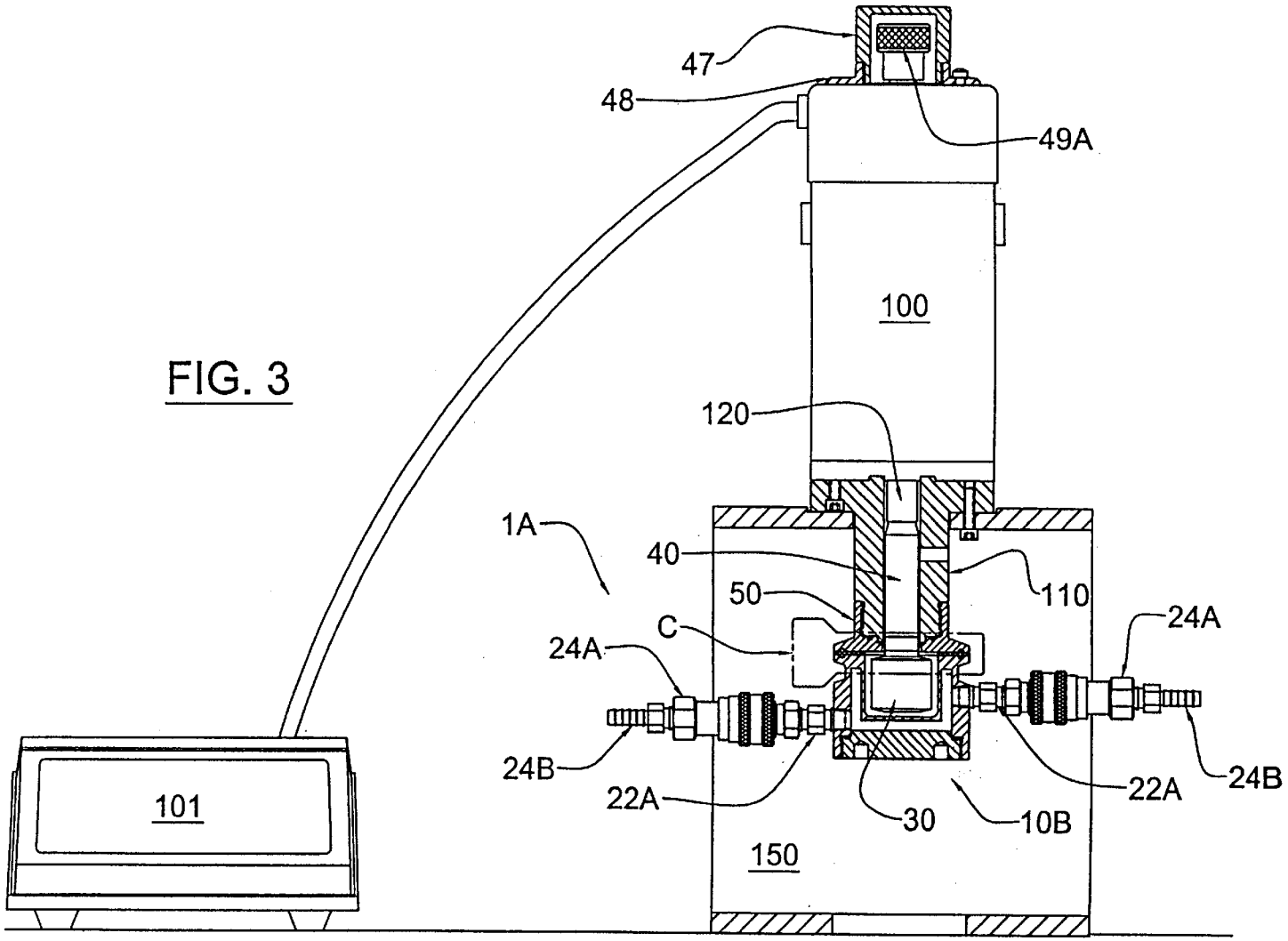
FIG. 3 illustrates a small-scale or micro-media mill according to another embodiment of the present invention.
Figure 3A:
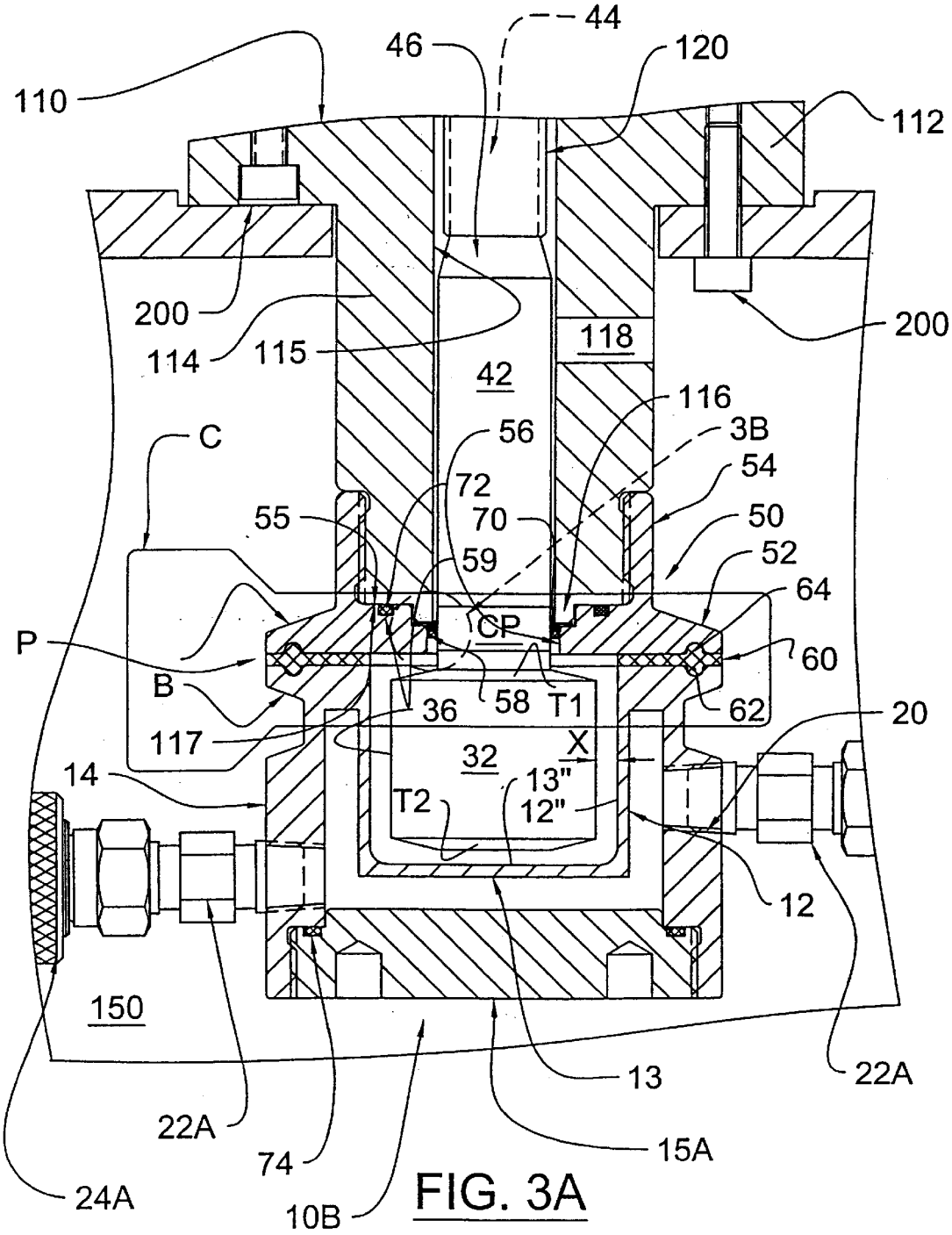
FIG. 3A illustrates an enlarged detailed view of the mill shown in FIG. 3.

FIGS. 3 and 3A show another embodiment of the double walled vessel 10B, which is substantially similar to that shown in FIGS. 1 and 1A. The primary difference is that the outer bottom wall 15A can be threaded or screwed (or sealingly mounted) into the outer cylindrical wall 14. In this respect, the outer bottom wall 15A can have an annular groove (not numbered) that seats an O-ring 74 or the like to provide a better water seal. Another difference from the vessel of FIGS. 1 and 1A, is that a quick couple fitting 22A, 24A, 24B is used. The connectors 22A are threadlingly mounted to the openings 20 formed in the outer cylindrical wall 14. The connectors 22A can use a commercially available quick connector or couple 24A, such as ⅛" PARKER series 60 Quick Couple. The quick couple 24A can be connected to a flexible hose barb 24A, such as a commercially available stainless steel ⅛" NPT×¼" hose barb. The double-walled vessels 10 and 10A can also use the quick couple fitting 22A, 24A, 24B instead of the sanitary fitting type described above and illustrated in FIGS. 1–2.

Alternative to the double walled vessel is a single walled vessel 10C shown in FIGS. 5 and 6. The single walled vessel 10C can be used when the product to be milled is not heat sensitive or for milling a short period. The single walled vessel is constructed similar to the inner vessel (12, 13) of the double walled vessel 10. A heat sink (not shown) can be attached to its cylindrical wall 12 and bottom wall 13. The heat sink also can be fan cooled. Another alternative cooling system can be a Peltier cooler, which operates on the Peltier effect theory (cooling by flowing an electric current through a Peltier module made of two different types of conductive or semiconductive materials attached together). A Peltier module with a heat sink (Peltier coolant) can be detachably attached to the vessel.

In the embodiments of FIGS. 1–3, 5, and 6, the mounting flange 52 of the coupling 50 is configured substantially the same as or complementary to the annular mounting flange 16. The mounting flanges 16 and 52 are coupled facing each other with the gasket 60, such as a Tri-Clamp EPDM black, FDA approved gasket, sandwiched therebetween, as shown in FIGS. 1A, 2, and 3A. The gasket 60 has annular lower 62 and upper 64 protrusions that engage the respective grooves G formed in the mounting flanges 16, 52, and align the flanges 16 and 52. A TRI-CLAMP C (see FIG. 3) can engage the periphery P and the beveled surfaces B of the mounting flanges 16, 52. When these flanges are aligned, they form a trapezoidal profile. Tightly wrapping the TRI-CLAMP around the periphery and the beveled surfaces B squeezes the flanges 16, 52 together to provide a sealed connection.

The mounting flanges 24 of the connectors 22 (FIGS. 1, 1A, 2) can be connected to their respective water source and drain pipes (not shown) in the same way as the vessel 10, 10A, 10B, 10C is connected to the coupling 50, as just described, using a gasket 60 and a TRI-CLAMP C.

Figure 3B:
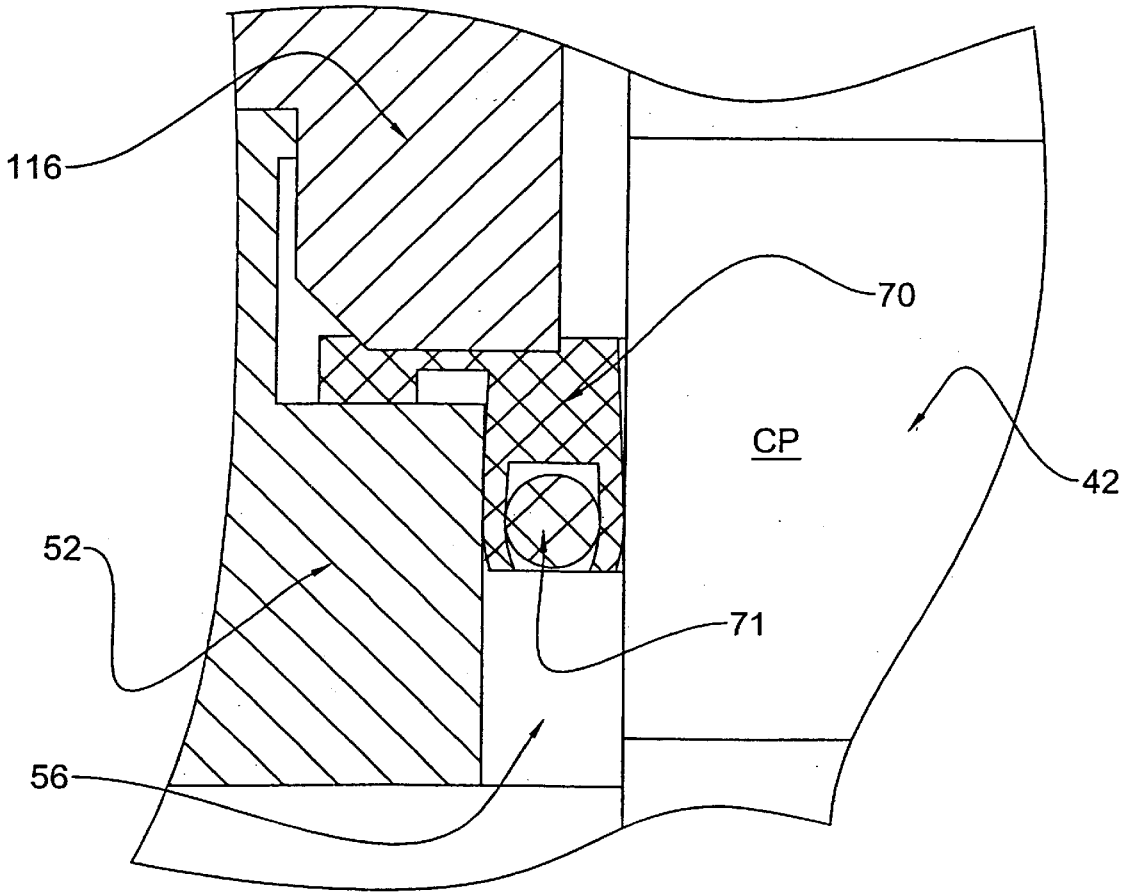
FIG. 3B illustrates an enlarged detailed view taken along area 3B of FIG. 3A.

Referring to the embodiments of FIGS. 1–3A, the coupling 50 also has a cylindrical portion 54 extending from its mounting flange 52. The flange 52 has a central opening 56 and a stepped recess 58 concentric with the opening 56. The recess 58 seats a seal, which can be a lip or mechanical seal ring 70 having a complementary configuration. Specifically, the seal ring 70 can be made from PTFE with a Wolastonite filler and can have an L-shaped (cross-sectional) profile as shown in detail in FIG. 3B. The seal ring 70 also can include a concentric O-ring 71 or the like, as shown in FIG. 3B. The opening 56 is dimensioned only slightly larger than the agitator's shaft 40. The seal ring 70 is adapted to engage the shaft 40 and seal the same while permitting the agitator 30 to rotate.

Referring to FIGS. 1A, 2, 3A, the cylindrical portion 54 is threaded on its inner side so that it can be attached to the motor 100. Specifically, the coupling 50 is attached to a shaft mount 110, which comprises an annular flange 112 and a downwardly extending cylindrical member 114. The cylindrical member 114 has an outer threading for threadingly mating with the threaded cylindrical portion 54 of the coupling 50. The flange 112 is mounted to the motor using bolts 200 or the like. The motor 100 can be mounted to a stand or fixture 150 via the flange 112, using bolts 200. The stand 150 allows the motor 100 and the vessel 10, 10A, 10B, 10C to be oriented vertically, as shown in FIGS. 1, 1A, 2, and 3.

The shaft mount 110 has a central through hole 115 dimensioned larger than the shaft 40. The distal (lower) end of the cylindrical member 114 has an annular projection 116 that bears against the seal ring 70 (see FIG. 3B) and holds the seal ring 70 in place. The coupling 50 has an annular end face 55 that abuts against a complementary face or shoulder 117 formed on the distal (lower) end of the cylindrical member 114, adjacent to the annular projection 116. The end face 55 provides a positive stop and maintains proper seal compression when the coupling 50 is mounted to the shaft mount 110. In this respect, referring to FIG. 3A, the mounting flange 52 can also include an O-ring 72 positioned in an annular groove 59 formed on the upper end face 55 to provide additional seal. As the temperature of the dispersion increases during milling, expanding air under pressure is designed to escape through the seal ring 70, while maintaining liquid seal. In this respect, the cylindrical member 114 has a vent opening 118 to vent any air seeping through the seal ring 70.

The rotor shaft 40 comprises a larger diameter portion 42 and a smaller diameter portion 44 having a threaded free end 45. A tapered section 46 extends between these portions 42, 44. The rotor 30 is attached to the motor 100 by inserting the smaller diameter portion 44 into a hollow motor shaft 120 and threading a nut 49 or a manual knob 49A (FIG. 3) onto the threaded end 45, which tightly pulls the tapered section 46 against the lower end or mouth of the hollow shaft 120, compressively attaching the agitator shaft 40 to the hollow motor shaft 120. The nut 49 or the knob 49A can be covered with a safety cap 47 (FIG. 3), which can be mounted to the top end of the motor 100 using a base 48. The cap 47 can be threadedly mounted to the base 48. The tapered section 46 also eases the insertion of the shaft 40 through the seal ring 70 and prevents tear or damage to the seal ring 70. At least around a section CP of the large diametered shaft portion 42 contacting the seal 70 is preferably coated with a wear resistant coating, such as a hard chrome coating to prevent wear.

Figure 4:
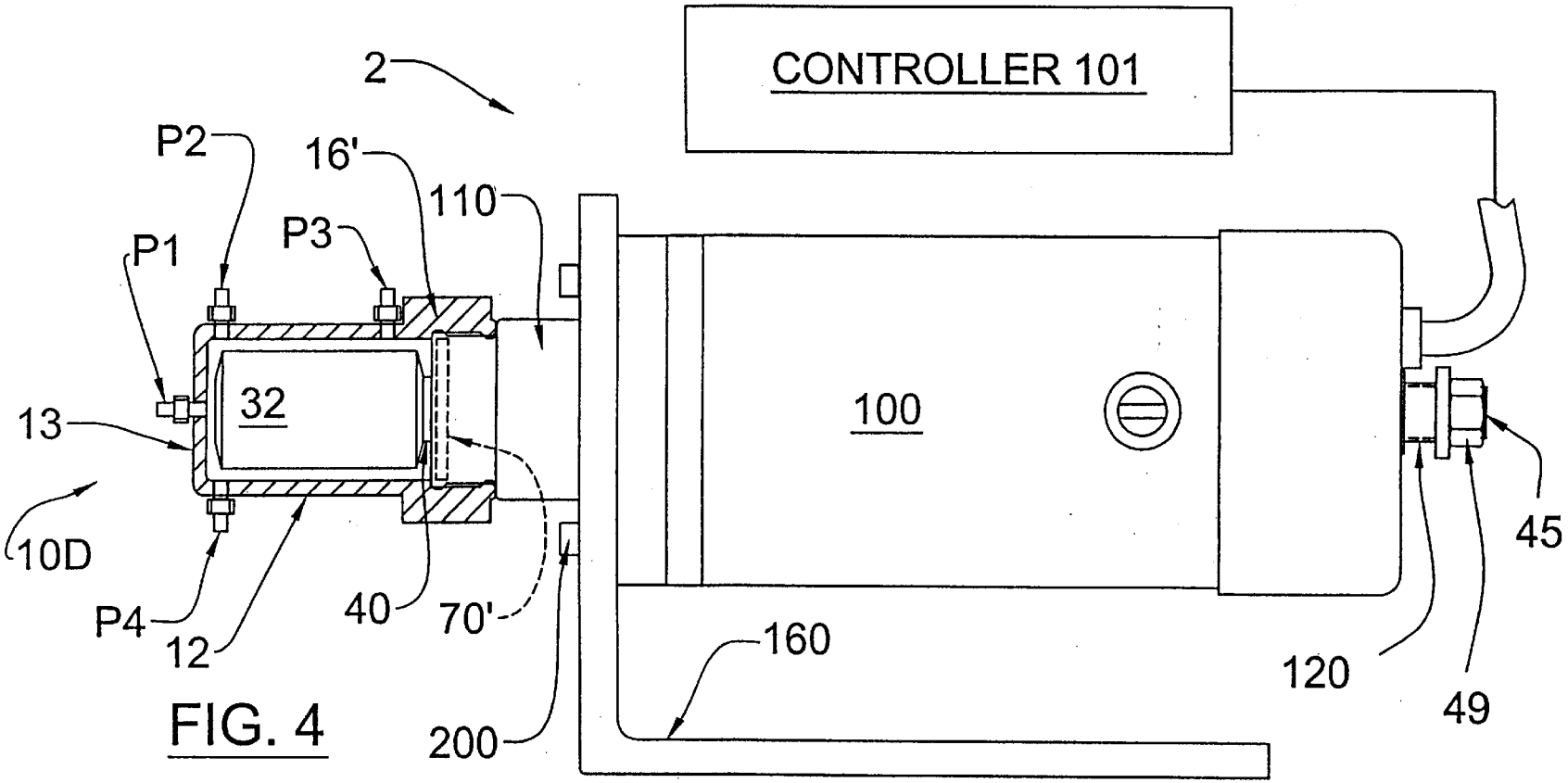
FIG. 4 illustrates a side view of a small scale or micro media mill according to another embodiment of the present invention.

Although the above-described mill 1 (FIGS. 1–3B) has been described and shown in a vertical configuration, the present invention also contemplates a horizontally oriented mill 2, as shown in FIG. 4. The horizontally oriented mill 2 is substantially similar to the vertically oriented mill 1 shown in FIGS. 1–3, except for the vessel and coupling configuration. In the horizontally oriented mill, a mounting bracket 160 is attached to the motor 100 via the shaft mount 110 so that the mill 2 is stably supported in the horizontal position, as shown in FIG. 4. In the horizontally oriented mill 2, its vessel 10D can be attached to the motor via a threaded coupling 16', and the shaft 40 can be sealed via a single or double mechanical seal, or a lip seal 70' (shown in phantom).

Referring to FIG. 4, the vessel 10D for the horizontally oriented mill 2 is substantially similar to the singled walled vessel 10C (FIGS. 5 and 6), except that the flange 16 (FIGS. 5 and 6) has a threaded coupling 16', substantially similar to the threaded coupling 50 shown in FIGS. 1–3A. The vessel 10D has an open cylindrical wall 12, with one closed by an end wall 13. The threaded coupling 16' is integrally or monolithically formed at the opposite open end. The vessel 10D, however, can be configured like the singled walled vessel 10C for use with the afore-described sanitary fitting.

The vessel 10D is illustrated with four fill/drain/cooling ports P1–P4 for illustrative purposes only. Only one port is needed in the horizontally oriented mill 2. The ports P2–P4 are radially extending through the cylindrical wall 12 of the vessel 10B, whereas the port P1 is axially extending from the end wall 13 of the vessel 10B. In one embodiment, the vessel 10D can have a single top fill port P2 or P3. In such an embodiment, it is especially desirable for the top port P2 or P3 to be located at or along the highest point of the milling chamber, i.e., at 12 O'clock position for a cylindrical vessel 10D, as this allows the chamber to be filled so that all of the air is displaced from the chamber. The absence of air in the milling chamber during operation prevents the formation of foam and enhances milling performance.

Alternatively, the horizontally oriented vessel 10D can contain two or more ports, such as two top radial ports P2 and P3, a single axial port P1 and a single top radial port P3, or a single top radial port P3 and a single bottom radial port P4. In such embodiments, the dispersion can be externally circulated through the vessel 10D, where one port acts as an outlet and the other an inlet. The dispersion can be cooled or replenished during the circulating process. Using two ports, one can recirculate (or add) the process fluid and/or attrition media via an external vessel and pump (not shown). If the attrition media has to remain in the vessel, the outlet port can be fitted with a suitable screen or filter to retain the media during operation. Referring to FIGS. 5–13D, the rotor 32, 32A–32J (collectively "32") for both the vertically and horizontally oriented mills 1, 1A, 2 can have different geometric configurations. The agitator 30 is preferably made of stainless steel or teflon or stainless steel with a teflon coating. In this respect, the TRI-CLAMP can be made of 304 stainless steel. The components that are exposed to the dispersion also can be made of 316 stainless steel. In fact, all of the metal components, except the clamp and the motor can be made of 316 stainless steel. Alternatively, all metal components that become exposed to the dispersion can be made of any material that is resistant to crevice corrosion, pitting, and stress corrosion, such as an AL-6XN stainless steel alloy. An AL-6XN alloy meets ASME and ASTM specifications, and is approved by the USDA for use as a food contact surface.

Figure 13C:
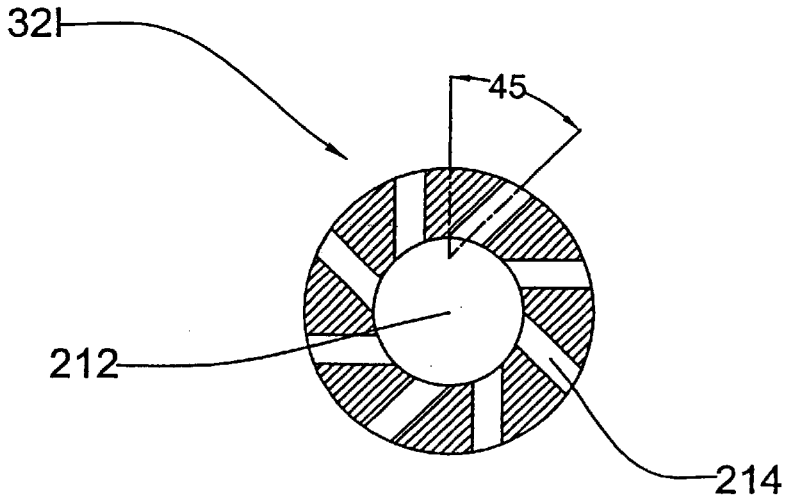
Figure 13B:
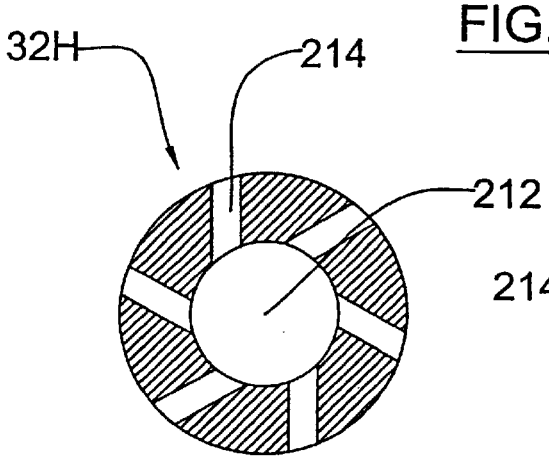
Figure 13D:
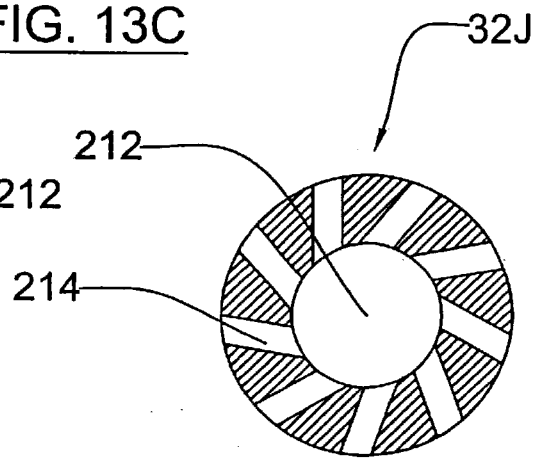

The rotor 32 also can comprise a variety of geometries, surface textures, and surface modifications, such as channels or protrusions to alter the fluid flow patterns. For example, the rotor 32 can be cylindrical (straight), as shown in FIG. 5, or cylindrical (tapered ends T1, T2) as shown in FIGS. 14 and 6. In other illustrated embodiments, the rotor 32 can be hexagonal (FIG. 7), ribbed (FIG. 8), square (FIG. 9), cylindrical with channels (FIGS. 10 and 11), cylindrical with passageways (FIG. 12), and cylindrical with a cavity and slots (FIGS. 13–13D). All of these embodiments can have tapered end surfaces T1, T2.

Figure 7:
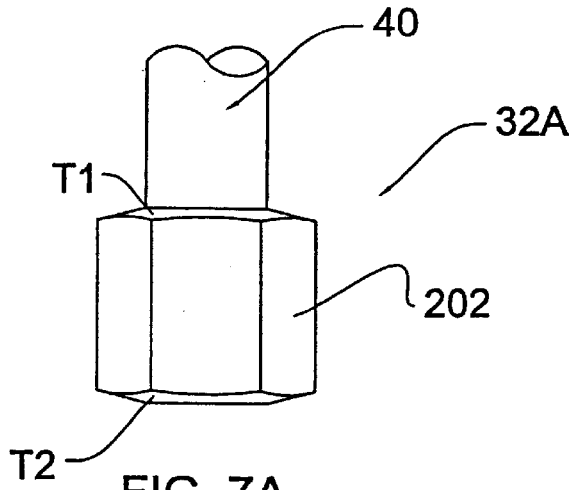
Figure 7A:
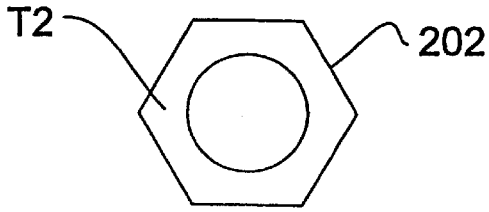
Figure 8:
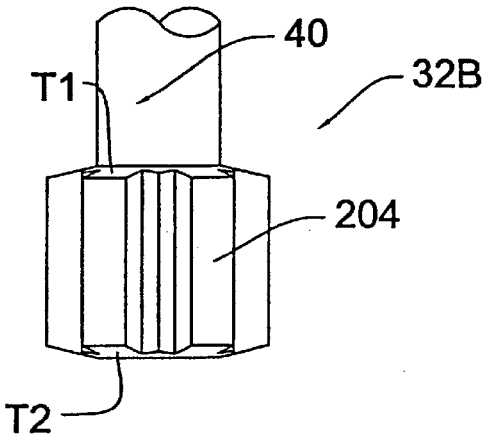
Figure 9:
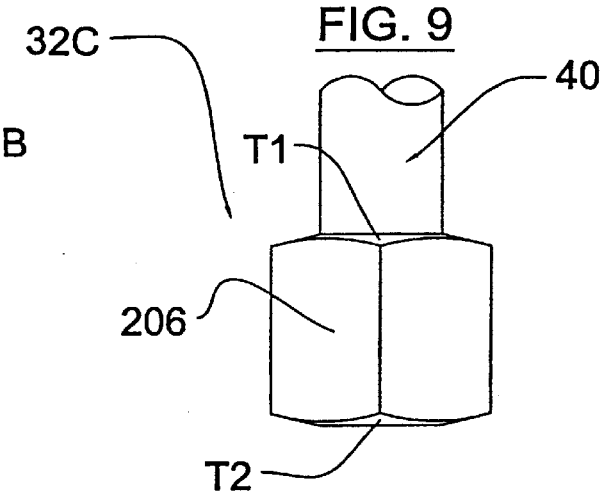
Figure 8A:
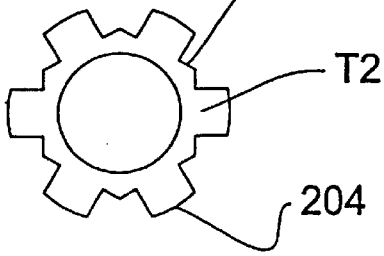
Figure 9A:
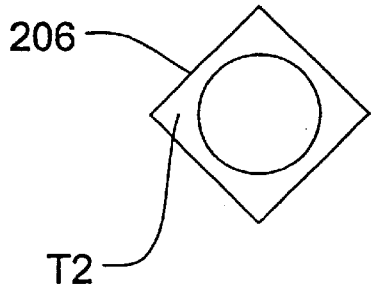

Specifically, the hexagonal rotor 32A (FIG. 7) has six planar sides 202. The ribbed rotor 32B (FIG. 8) has hexagonal sides 202 as shown in FIG. 7, but with six ribs 204 extending respectively from the middle of each of the six sides 202. The square rotor 32C (FIG. 9) has four planar sides 206. The cylindrical rotor 32D (FIG. 10) has four channels 208 that are perpendicular to each adjacent channels 208. The cylindrical rotor 32E (FIG. 11) is substantially identical to the cylindrical rotor 32D of FIG. 10, but has six channels 208 instead of four, symmetrically angled and spaced apart. The cylindrical rotor 32F (FIG. 12) has four angled passageways 210, extending from the tapered or conical end surfaces T1, T2. These angled passageways have four openings at the first tapered end surface T1 and four openings at the second tapered end surface T2. An imaginary circle intercepting the four openings at the first tapered end surface T1 has a greater diameter than an imaginary circle intercepting the four openings at the second tapered end surface T2.

The cylindrical rotors 32G, 32H, 32I, 32J (FIGS. 13–13D) each have a concentrical cylindrical cavity 212 opening to the second tapered surface T2. Depending on the material and the media mill size, these rotors can have at least three (not shown) equally spaced apart axially extending flow modifying channels 214. The rotors 32G–23J are respectively shown with four, six, eight, and nine channels 214. These slots 214 can also be angled as shown, or spiraled or helically configured (not shown) relative to the rotational axis. In the embodiment of FIG. 13A, four channels 214 can be angled 90° relative to the adjacent channels. In the embodiment of FIG. 13B, the six channels 214 can be angled 60°. In the embodiment of FIG. 13C, the eight channels 214 can be angled 45°. In the embodiment of FIG. 13D, the nine channels 214 can be angled 40° relative to the vertical. In alternative embodiments (not shown), the channels 214 can radially extend from the axis of the rotor 41.

The rotors 32G–32J of FIGS. 13A–13D can act as a pump. That is, these rotors can withdraw fluid into the cavity 212 and eject fluid outwardly through the channels 214, or conversely withdraw fluid into the cavity through the channels 214 and eject fluid outwardly through the cavity 212, depending on the direction of the rotation, to modify the dispersion flow pattern.

In other embodiments (not shown), rotors also can contain pegs, agitator discs, or a combination thereof.

Referring to the cylindrical rotor 32 shown in FIGS. 1–6, its outer peripheral cylindrical surface 36 and the inner cylindrical surface 12" of the inner cylindrical wall 12 of the vessel 10, 10A, 10B, 10C, 10D are dimensioned to provide a small gap X. The gap X is preferably no greater than 3 mm and no smaller than 0.3 mm. In general, this gap X should be approximately 6 times the diameter of the milling media, which is preferably made of cross linked polystyrene or other polymer as described in U.S. Pat. No. 5,718,388 issued to Czekai, et al. The largest attrition milling media preferably is nominally sized no greater than 500 microns (0.5 mm). Presently, the smallest attrition milling media contemplated is about 50 microns. Nonetheless, it is envisioned that a smaller attrition milling media can be suitable for milling certain non-soluble products, such as pharmaceutical products, which means that the gap X can be made smaller accordingly.

The vessel size can vary for milling small amounts of dispersion. Although the present invention is not limited to particular sizes, in the preferred embodiment, the inner diameter of the vessel is between ⅝ inch to 4 inches. By way of examples only, milling chamber of the vessel 10, 10A, 10B, 10C, and 10D and the cylindrical rotor 32 can have the dimensions specified in Tables 1 and 2.

TABLE 1

(STRAIGHT ROTORS)

| CYLINDRICAL VESSEL Size | #1 | #2 | #3 |
|---|---|---|---|
| TRI-CLAMP Size | 2" TC | 2.5" TC | 3" TC |
| VESSEL/COUPLING | | | |
| R-vessel (inch) (½ DC) | 0.685 | 0.935 | 1.185 |
| H-vessel (inch) (HC) | 1.125 | 1.125 | 1.125 |
| R-rotor (inch) (½ DR) | 0.567 | 0.817 | 1.063 |
| H-rotor (inch) (HR) | 0.890 | 0.890 | 0.890 |
| R-shaft (inch) (½ DS) | 0.313 | 0.313 | 0.313 |
| H-shaft (inch) (HS) | 0.118 | 0.118 | 0.118 |
| Volume Vessel ($in^3$) | 1.658 | 3.090 | 4.963 |
| Volume Rotor ($in^3$) | 0.899 | 1.866 | 3.156 |
| Volume Shaft ($in^3$) | 0.036 | 0.036 | 0.036 |

TABLE 1-continued (STRAIGHT ROTORS)

| CYLINDRICAL VESSEL Size | #1 | #2 | #3 |
|---|---|---|---|
| Working Volume ($in^3$) | 0.723 | 1.187 | 1.770 |
| | 11.855 ml | 19.458 ml | 29.012 ml |
| Typical Dispersion Volume @ 50% media charge | 8.299 ml | 13.621 ml | 20.309 ml |
| Typical Dispersion Volume @ 90% media charge | 5.453 ml | 8.951 ml | 13.346 ml |

TABLE 2

(TAPERED ROTORS)

| VESSEL Size | #1 | #2 | #3 |
|---|---|---|---|
| TRI-CLAMP Size | 2" TC | 2.5" TC | 3" TC |
| VESSEL/COUPLING | | | |
| R-vessel (inch) (½ DC) | 0.685 | 0.935 | 1.185 |
| H-vessel (inch) (HC) | 1.190 | 1.190 | 1.190 |
| R-rotor (inch) (½ DR) | 0.567 | 0.817 | 1.063 |
| H-rotor(inch) (HR) | 1.018 | 1.018 | 1.018 |
| H-top taper (inch) (HTT) | 0.064 | 0.120 | 0.120 |
| H-bottom taper (inch) (HBT) | 0.064 | 0.075 | 0.075 |
| R-shaft (inch) (½ DS) | 0.313 | 0.313 | 0.313 |
| H-shaft (inch) (HS) | 0.086 | 0.086 | 0.086 |
| Volume Vessel ($in^3$) | 1.754 | 3.268 | 5.250 |
| Volume Rotor Body ($in^3$) | 0.899 | 1.726 | 2.919 |
| Volume Upper Cone ($in^3$) | 0.040 | 0.128 | 0.196 |
| Volume Lower Cone ($in^3$) | 0.040 | 0.080 | 0.122 |
| Volume Shaft ($in^3$) | 0.026 | 0.026 | 0.026 |
| Volume Complete Rotor ($in^3$) | 0.979 | 1.934 | 3.237 |
| Working Volume ($in^3$) | 0.749 | 1.308 | 1.986 |
| | 12.274 ml | 21.429 ml | 32.548 ml |
| Typical Dispersion Volume @ 50% media charge | 8.592 ml | 15.001 ml | 22.784 ml |
| Typical Dispersion Volume @ 90% media charge | 5.646 ml | 9.858 ml | 14.972 ml |

It was mentioned that the gap X between the rotor 32 and the inner surface 12" of the cylindrical wall 12 should be approximately 6 times the diameter of the attrition milling media. Nonetheless, the vessel and rotor combination can be used with 50, 200, 500 and mixtures of 50/200, 50/500, or 50/200/500 micron media. These milling media also can be used with a gap X of 1 mm. The rotor speed is correlated to the rotor diameter to produce different tip speeds, which are related to the milling action. A too high tip speed can generate much heat and can evaporate the dispersion. A too low tip speed causes inefficient milling.

Tapering the ends of the rotor 32, as illustrated in FIGS. 1–4 and 6–13D can provide more uniform shear throughout the milling chamber. Although the shear rate between two concentric cylinders is relatively constant if the gap is narrow, a flat end (bottom or top) surface cylinder will produce less uniform shear stress. Referring to FIG. 6, by equating the shear rate for concentric cylinders and a cone shape surface T2 revolving about a flat bottomed vessel surface 13", one can calculate a tip angle $\beta$=arc tan (1—DR/DC), where DR represents an outer cylindrical surface 36 of the rotor 32 and DC represents an inner cylindrical surface 12" of the vessel 10, 10A, 10B, 10C, 10D. Ideally, the cone should "touch" the bottom (or the top or the ends) to maintain a constant shear. This, however, is not practical. Instead, a cone is truncated, forming a gap d between the truncated bottom surface T2 and the opposing bottom vessel surface 13". The gap d is preferably defined by $DT/2 \times \tan\beta$, where DT/2 is the distance between the center of rotation and the truncation edge. If DT/2 is sufficiently small in comparison with DR/2, a substantially uniform shear can be maintained. A uniform shear rate would allow the user to better estimate shearing effect in the milling of colloidal dispersions, although constant shear in the mill is not necessary to produce a colloidal dispersion. Another benefit to having a tapered bottom surface T2 is that it prevents the accumulation of suspended particles on the bottom near the center of rotation where the speed is at its minimal.

U.S. Pat. No. 5,145,684 issued to Liversidge et al., U.S. Pat. No. 5,518,187 issued to Bruno et al., and U.S. Pat. Nos. 5,718,388 and 5,862,999 issued to Czekai et al. disclose milling pharmaceutical products using polymeric milling media. These patents further disclose dispersion formulations for wet media milling. The disclosures of these patents are incorporated herein by reference.

In operation of the vertically oriented mill 1, 1A, an appropriate dispersion formulation containing the milling media and the product to be milled is prepared, which can be prepared according to the aforementioned patents. The dispersion is poured into the, vessel 10, 10A, 10B, 10C to a level that would cause the dispersion to fill to the brim or the top face 61 (see FIGS. 5 and 6) of the gasket 60 (or even overflow) when the rotor 30 fully inserted to the vessel 10 to minimize trapping of air within the vessel. After filling appropriate amount of the dispersion into the vessel 10, 10A, 10C, the vessel is aligned with the coupling 50, which is premounted to the shaft mount 110, and raised until the vessel and coupling flanges 16, 52 line up. The aligned coupling flanges 16, 52 are held together using, for instance, a TRI-CLAMP C or the like, which couples the vessel 10, 10A, 10B, 10C to the coupling 50 and seals the dispersion. Similarly, the connectors 22, 22A are connected to a coolant inlet and outlet respectively using two TRI-CLAMPs or quick coupling 24A, one for each connector 22, 22A. Coolant, such as water, is circulated to cool the vessel 10, 10A, 10B, 10C. The motor controller 101 can be set to rotate the rotor for a predetermined period, depending on the dispersion formulation.

As disclosed in U.S. Pat. No. 5,145,684 for "Surface Modified Drug Nanoparticles" to Liversidge et al., the drug substance must be poorly soluble and dispersible in at least one liquid medium. By "poorly soluble" it is meant that the drug substance has a solubility in the liquid dispersion medium of less than about 10 mg/ml, and preferably of less than about 1 mg/ml. A preferred liquid dispersion medium is water. However, other liquid media in which a drug substance is poorly soluble and dispersible can be employed in the milling process, such as, for example, aqueous salt solutions, safflower oil, and solvents such as ethanol, t-butanol, hexane, and glycol.

Suitable drug substances can be selected from a variety of known classes of drugs including, for example, analgesics, anti-inflammatory agents, anthelmintics, anti-arrhythmic agents, antibiotics (including penicillins), anticoagulants, antidepressants, antidiabetic agents, antiepileptics, antihistamines, antihypertensive agents, antimuscarinic agents, antimycobacterial agents, antineoplastic agents, immunosuppressants, antithyroid agents, antiviral agents, anxiolytic sedatives (hypnotics and neuroleptics), astringents, beta-adrenoceptor blocking agents, blood products and substitutes, cardiac inotropic agents, contrast media, corticosteroids, cough suppressants (expectorants and mucolytics), diagnostic agents, diagnostic imaging agents, diuretics, dopaminergics (antiparkinsonian agents), haemostatics, immunological agents, lipid regulating agents, muscle relaxants, parasympathomimetics, parathyroid calcitonin and biphosphonates, prostaglandins, radiopharmaceuticals, sex hormones (including steroids), antiallergic agents, stimulants and anoretics, sympathomimetics, thyroid agents, vasodilators, xanthines, and antiviral agents. Preferred drug substances include those intended for oral administration and intravenous administration. A description of these classes of drugs and a listing of species within each class can be found in Martindale, *The Extra Pharmacopoeia*, Twenty-ninth Edition (The Pharmaceutical Press, London, 1989), the disclosure of which is hereby incorporated by reference in its entirety. The drug substances are commercially available and/or can be prepared by techniques known in the art.

In addition, as taught in U.S. Pat. No. 5,718,388 for "Continuous Method of Grinding Pharmaceutical Substances" to Czekai et al.; U.S. Pat. No. 5,518,187 for "Method of Grinding Pharmaceutical Substances" to Bruno et al.; and U.S. Pat. No. 5,862,999 for "Method of Grinding Pharmaceutical Substances" to Czekai et al., other suitable drug substances include NSAIDs described in U.S. patent application Ser. No. 897,193, filed on Jun. 10, 1992, and the anticancer agents described in U.S. patent application Ser. No. 908,125, filed on Jul. 1, 1992. U.S. patent application Ser. No. 897,193 was abandoned and refiled on Mar. 13, 1995, as U.S. patent application Ser. No. 402,662, now U.S. Pat. No. 5,552,160 for "Surface Modified NSAID Nanoparticles." U.S. patent application Ser. No. 908,125 issued as U.S. Pat. No. 5,399,363 for "Surface Modified Anticancer Nanoparticles."

U.S. Pat. No. 5,552,160 states that useful NSAIDS can be selected from suitable acidic and nonacidic compounds. Suitable acidic compounds include carboxylic acids and enolic acids. Suitable nonacidic compounds include, for example, nabumetone, tiaramide, proquazone, bufexamac, flumizole, epirazole, tinoridine, timegadine, and dapsone. Suitable carboxylic acid NSAIDs include, for example: (1) salicylic acids and esters thereof, such as aspirin; (2) phenylacetic acids such as diclofenac, alclofenac, and fenclofenac; (3) carbo- and heterocyclic acetic acids such as etodolac, indomethacin, sulindac, tolmetin, fentiazac, and tilomisole; (4) propionic acids such as carprofen, fenbufen, flurbiprofen, ketoprofen, oxaprozin, suprofen, tiaprofenic acid, ibuprofen, naproxen, fenoprofen, indoprofen, and pirprofen; and (5) fenamic acids such as flufenamic, mefenamic, meclofenamic, and niflumic. Suitable enolic acid NSAIDs include, for example: (1) pyrazolones such as oxyphenbutazone, phenylbutazone, apazone, and feprazone; and (2) oxicams such as piroxicam, sudoxicam, isoxicam, and tenoxicam.

U.S. Pat. No. 5,399,363 states that useful anticancer agents are preferably selected from alkylating agents, antimetabolites, natural products, hormones and antagonists, and miscellaneous agents, such as radiosensitizers.

Examples of alkylating agents include: (1) alkylating agents having the bis-(2-chloroethyl)-amine group such as, for example, chlormethine, chlorambucile, melphalan, uramustine, mannomustine, extramustinephoshate, mechlore-thaminoxide, cyclophosphamide, ifosfamide, and trifosfamide; (2) alkylating agents having a substituted aziridine group such as, for example, tretamine, thiotepa, triaziquone, and mitomycine; (3) alkylating agents of the alkyl sulfonate type, such as, for example, busulfan, piposulfan, and piposulfam; (4) alkylating N-alkyl-N-nitrosourea derivatives, such as, for example, carnustine, lomustine, semustine, or streptozotocine; and (5) alkylating agents of the mitobronitole, dacarbazine, and procarbazine type.

Examples of antimetabolites include: (1) folic acid analogs, such as, for example, methotrexate; (2) pyrimidine analogs such as, for example, fluorouracil, floxuridine, tegafur, cytarabine, idoxuridine, and flucytosine; and (3) purine derivatives such as, for example, mercaptopurine, thioguanine, azathioprine, tiamiprine, vidarabine, pentostatin, and puromycine.

Examples of natural products include: (1) vinca alkaloids, such as, for example, vinblastine and vincristine; (2) epipodophylotoxins, such as, for example, etoposide and teniposide; (3) antibiotics, such as, for example, adriamycine, daunomycine, doctinomycin, daunorubicin, doxorubicin, mithramycin, bleomycin, and mitomycin; (4) enzymes, such as, for example, L-asparaginase; (5) biological response modifiers, such as, for example, alpha-interferon; (6) camptothecin; (7) taxol; and (8) retinoids, such as retinoic acid.

Examples of hormones and antagonists include: (1) adrenocorticosteroids, such as, for example, prednisone; (2) progestins, such as, for example, hydroxyprogesterone caproate, medroxyprogesterone acetate, and megestrol acetate; (3) estrogens, such as, for example, diethylstilbestrol and ethinyl estradiol; (4) antiestrogens, such as, for example, tamoxifen; (5) androgens, such as, for example, testosterone propionate and fluoxymesterone; (6) antiandrogens, such as, for example, flutamide; and (7) gonadotropin-releasing hormone analogs, such as, for example leuprolide.

Examples of miscellaneous agents include: (1) radiosensitizers, such as, for example, 1,2,4-benzotriazin-3-amine 1,4-dioxide (SR 4889) and 1,2,4-benzotriazine-7-amine 1,4-dioxide (WIN 59075); (2) platinum coordination complexes such as cisplatin and carboplatin; (3) anthracenediones, such as, for example, mitoxantrone; (4) substituted ureas, such as, for example, hydroxyurea; (5) and adrenocortical suppressants, such as, for example, mitotane and aminoglutethimide.

In addition, the anticancer agent can be an immunosuppressive drug, such as, for example, cyclosporine, azathioprine, sulfasalazine, methoxsalen, and thalidomide.

Because the coupling 50 seals the vessel 10, 10A, 10B, 10C, and because only a very small amount of air is trapped in the vessel, vortexing and contamination problems are minimized or avoided. Thus, the mill according to the present invention can prevent the dispersion formulation from foaming. Further, because the vessel is cooled, either by the cooling jacket or by circulating the dispersion, the rotor 32 can be spun faster. Thus, a higher energy can be transferred to the dispersion.

In the operation of the horizontally oriented mill 2, the vessel 10D is first mounted to the shaft mount 110 with either a threaded coupling 16' (as shown in FIG. 4) or a sanitary fitting (as shown in FIGS. 1–3) and with the rotor 32 positioned inside the vessel 10D as shown in FIG. 4. The dispersion formulation containing the milling media and the product to be milled is poured or injected through the top port P2 or P3 (only one being required) until all or substantially all of the air is displaced with the dispersion. The motor controller 101 then can be set to rotate the rotor 32 for a predetermined period, depending on the dispersion formulation. If the vessel 10D has multiple ports, such as P1, P3 or P2, P3, or P3, P4, the dispersion can be circulated via an external vessel and pump (not shown) during milling.

Because virtually all or substantially all of the air can be displaced in the horizontally oriented mill 2, vortexing and contamination problems are minimized or avoided. Thus, the mill according to the present invention can prevent the dispersion formulation from foaming. Further, because the dispersion can be circulated, where it can be cooled with external cooling system, the rotor can be spun faster and high energy can be transferred to the dispersion. Moreover, the dispersion can be refreshed or made in batches or inspected without having to disassemble the vessel 10D from the shaft mount 110.

The pharmaceutical products herein include those products described in the aforementioned patents incorporated herein by reference and any human or animal ingestable products and cosmetic products.

Given the disclosure of the present invention, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set forth in the appended claims.

We claim:

1. A method of milling a non-soluble product, comprising:

(a) providing a dispersion containing a non-soluble product to be milled and attrition milling media having a nominal size of no greater than about 500 microns;

(b) inserting the dispersion into a cylindrical vessel;

(c) providing an agitator and a coupling that closes the vessel, the coupling having an opening through which a portion of the agitator extends, the agitator comprising a cylindrical rotor and a shaft extending therefrom, wherein the cylindrical rotor is dimensioned so that an outer periphery is no greater than 3 mm away from an inner surface of the cylindrical vessel;

(d) inserting the agitator into the cylindrical vessel and sealingly closing the coupling, wherein the vessel is filled so that the dispersion eliminates substantially all of the air in the vessel when the agitator is fully inserted into the vessel; and (e) rotating the agitator for a predetermined period.

2. The method according to claim 1, further including cooling the vessel.

3. The method according to claim 2, wherein the vessel is cooled by jacketing the vessel and flowing water between the jacket and the vessel.

4. The method according to claim 1, wherein the non-soluble product is selected from the group consisting of a pharmaceutical product, a human ingestable product, an animal ingestable product, and a cosmetic product.

5. The method of claim 4, wherein the pharmaceutical product is a heat sensitive product.

6. The method of claim 1, comprising milling the non-soluble product with the attrition media, wherein the attrition media is polymeric.

7. The method of claim 1, wherein the product is selected from the group consisting of analgesics, anti-inflammatory agents, anthelmintics, anti-arrhythmic agents, antibiotics, anticoagulants, antidepressants, antidiabetic agents, antiepileptics, antihistamines, antihypertensive agents, anti-muscarinic agents, antimycobacterial agents, antineoplastic agents, immunosuppressants, antithyroid agents, antiviral agents, anxiolytic sedatives, astringents, beta-adrenoceptor blocking agents, blood products, blood substitutes, cardiac inotropic agents, contrast media, corticosteroids, cough suppressants, diagnostic agents, diagnostic imaging agents, diuretics, dopaminergics, haemostatics, immunological agents, lipid regulating agents, muscle relaxants, parasympathomimetics, parathyroid calcitonin, parathyroid biphosphonates, prostaglandins, radio-pharmaceuticals, sex hormones, anti-allergic agents, stimulants, anoretics, sympathomimetics, thyroid agents, vasodilators, and xanthines.

8. The method of claim 1, wherein the product is an NSAID.

9. The method of claim 8, wherein the NSAID is selected from the group consisting of nabumetone, tiaraide, proquazone, bufexamac, flumizole, epirazole, tinoridine, timegadine, dapsone, aspirin, diclofenac, alclofenac, fenclofenac, etodolac, indomethacin, sulindac, tolmetin, fentiazac, tilomisole, carprofen, fenbufen, flurbiprofen, ketoprofen, oxaprozin, suprofen, tiaprofenic acid, ibuprofen, naproxen, fenoprofen, indoprofen, pirprofen, flufenamic, mefenamic, meclofenamic, niflumic, oxyphenbutazone, phenylbutazone, apazone, feprazone, piroxicam, sudoxicam, isoxicam, and tenoxicam.

10. The method of claim 1, wherein the product is an anticancer agent.

11. The method of claim 10, wherein the anticancer agent is selected from the group consisting of alkylating agents, antimetabolites, natural products, hormones, and antagonists.

12. The method of claim 11, wherein the anticancer agent is selected from the group consisting of: (1) alkylating agents having the bis-(2-chloroethyl)-amine group; (2) alkylating agents having a substituted aziridine group; (3) alkylating agents of the alkyl sulfonate type; (4) alkylating N-alkyl-N-nitrosourea derivatives; (5) alkylating agents of the mitobronitole type; (6) alkylating agents of the dacarbazine type; and (7) alkylating agents of the procarbazine type.

13. The method of claim 12 wherein the anticancer agent is selected from the group consisting of chlormethine, chlorambucile, melphalan, uramustine, mannomustine, extramustinephoshate, mechlore-thaminoxide, cyclophosphamide, ifosfamide, trifosfamide, tretamine, thiotepa, triaziquone, mitomycine, busulfan, piposulfan, piposulfam, carmustine, lomustine, semustine, streptozotocine.

14. The method of claim 11, wherein the anticancer agent is selected from the group consisting of: (1) folic acid analogs; (2) pyrimidine analogs; and (3) purine derivatives.

15. The method of claim 14, wherein the anticancer agent is selected from the group consisting of methotrexate, fluorouracil, floxuridine, tegafur, cytarabine, idoxuridine, flucytosine, mercaptopurine, thioguanine, azathioprine, tiamiprine, vidarabine, pentostatin, and puromycine.

16. The method of claim 11, wherein the anticancer agent is selected from the group consisting of vinca alkaloids, epipodophylotoxins, antibiotics, enzymes, biological response modifiers, camptothecin, taxol, and retinoids.

17. The method of claim 16, wherein the anticancer agent is selected from the group consisting of vinblastine, vincristine, etoposide, teniposide, adriamycine, daunomycine, doctinomycin, daunorubicin, doxorubicin, mithramycin, bleomycin, mitomycin, L-asparaginase, alpha-interferon and retinoic acid.

18. The method of claim 11, wherein the anticancer agent is selected from the group consisting of adrenocorticosteroids, progestins, estrogens, antiestrogens, androgens, antiandrogens, and gonadotropin-releasing hormone analogs.

19. The method of claim 18, wherein the anticancer agent is selected from the group consisting of prednisone, hydroxyprogesterone caproate, medroxyprogesterone acetate, megestrol acetate, diethylstilbestrol, ethinyl estradiol, tamoxifen, testosterone propionate, fluoxymesterone, flutamide, and leuprolide.

20. The method of claim 11, wherein the anticancer agent is selected from the group consisting of radiosensitizers, platinum coordination complexes, anthracenediones, substituted ureas, adrenocortical suppressants, and an immunosuppressive drug.

21. The method of claim 1, comprising milling the non-soluble product, wherein the ratio of the distance between the outer periphery of the cylindrical rotor and the inner surface of the cylindrical vessel to the attrition milling media nominal size is about 6 to about 1.

22. The method of claim 21, wherein the attrition media has a particle size selected from the group consisting of: (1) a mixture of about 50 microns and about 200 microns; (2) a mixture of about 50 microns and about 500 microns; (3) a mixture of about 50 microns, about 200 microns, and about 500 microns; (4) no greater than about 500 microns; (5) no greater than about 200 microns; (6) about 50 microns up to about 500 microns; (7) about 500 microns; (8) about 200 microns; and (9) about 50 microns.

23. The method of claim 21, comprising milling the non-soluble product in the cylindrical vessel, wherein the working volume of the vessel is about 12 mL to about 33 mL.

24. The method of claim 21, wherein the volume of the dispersion is about 5 ml to about 23 mL.

25. The method of claim 21, wherein the volume of the dispersion is less than about 10 mL.

26. The method of claim 21, wherein the method further comprises maintaining substantially uniform shear between the rotor and the cylindrical vessel.

27. The method of claim 21, wherein at the completion of the rotation period, the product has a particle size in the range of microns to nanometers.

28. The method of claim 27, wherein at the completion of the rotation period, the product has a particle size of less than about 500 nm.

29. The method of claim 27, wherein at the completion of the rotation period, the product has an average particle size of less than about 400 nm.

30. The method of claim 27, wherein at the completion of the rotation period, the product has an average particle size of less than about 300 nm.

31. The method of claim 27, wherein at the completion of the rotation period, the product has an average particle size of less than about 100 nm.

32. The method of claim 21 wherein the cylindrical vessel is horizontally orientated when the agitator is inserted into the vessel.

33. The method of claim 21, further including externally circulating the dispersion.

34. The method of claim 27, wherein the predetermined period of rotation of the agitator is a few hours or less.

35. The method of claim 21, further comprising minimizing vortexing during rotation of the agitator.

36. The method of claim 21, further comprising preventing the dispersion formulation from foaming.

37. The method of claim 21, wherein the dispersion is retained in the vessel during rotation of the agitator.

38. The method of claim 21, wherein the dispersion is recirculated through the vessel during rotation of the agitator.

39. A method of milling a product, wherein the product is selected from the group consisting of a pharmaceutical product, a human ingestable product, an animal ingestable product, and a cosmetic product, comprising:

(a) providing a dispersion containing the product to be milled and attrition milling media having a nominal size of no greater than about 500 microns;

(b) inserting the dispersion into a cylindrical vessel;

(c) providing an agitator and a coupling that closes the vessel, the coupling having an opening through which a portion of the agitator extends, the agitator comprising a cylindrical rotor and a shaft extending therefrom, wherein the cylindrical rotor is dimensioned so that an outer periphery is no greater than 3 mm away from an inner surface of the cylindrical vessel;

(d) inserting the agitator into the cylindrical vessel and sealingly closing the coupling, wherein the vessel is filled so that the dispersion eliminates substantially all of the air in the vessel when the agitator is fully inserted into the vessel; and (e) rotating the agitator for a predetermined period.

40. The method of claim 39, comprising milling the product, wherein the ratio of the distance between the outer periphery of the cylindrical rotor and the inner surface of the cylindrical vessel to the attrition milling media nominal size is about 6 to about 1.

41. The method of claim 40, wherein the pharmaceutical product is a heat sensitive product.

42. The method of claim 40, wherein the product is selected from the group consisting of analgesics anti-inflammatory agents, anthelmintics, anti-arrhythmic agents, antibiotics, anticoagulants, antidepressants, antidiabetic agents, antiepileptics, antihistamines, antihypertensive agents, antimuscarinic agents, antimycobacterial agents, antineoplastic agents, immunosuppressants, antithyroid agents, antiviral agents, anxiolytic sedatives, astringents, beta-adrenoceptor blocking agents, blood products, blood substitutes, cardiac inotropic agents, contrast media, corticosteroids, cough suppressants, diagnostic agents, diagnostic imaging agents, diuretics, dopaminergics, haemostatics, immunological agents, lipid regulating agents, muscle relaxants, parasympathomimetics, parathyroid calcitonin, parathyroid biphosphonates, prostaglandins, radio-pharmaceuticals, sex hormones, anti-allergic agents, stimulants, anoretics, sympathomimetics, thyroid agents, vasodilators, and xanthines.

43. The method of claim 40, wherein the product is an NSAID.

44. The method of claim 40, wherein the NSAID is selected from the group consisting of nabumetone, tiaramide, proquazone, bufexamac, flumizole, epirazole, tinoridine, timegadine, dapsone, aspirin, diclofenac, alclofenac, fenclofenac, etodolac, indomethacin, sulindac, tolmetin, fentiazac, tilomisole, carprofen, fenbufen, flurbiprofen, ketoprofen, oxaprozin, suprofen, tiaprofenic acid, ibuprofen, naproxen, fenoprofen, indoprofen, pirprofen, flufenamic, mefenamic, meclofenamic, niflumic, oxyphenbutazone, phenylbutazone, apazone, feprazone, piroxicam, sudoxicam, isoxicam, and tenoxicam.

45. The method of claim 40, wherein the product is an anticancer agent.

46. The method of claim 45, wherein the anticancer agent is selected from the group consisting of alkylating agents, antimetabolites, natural products, hormones, and antagonists.

47. The method of claim 46, wherein the anticancer agent is selected from the group consisting of: (1) alkylating agents having the bis-(2-chloroethyl)-amine group; (2) alkylating agents having a substituted aziridine group; (3) alkylating agents of the alkyl sulfonate type; (4) alkylating N-alkyl-N-nitrosourea derivatives; (5) alkylating agents of the mitobronitole type; (6) alkylating agents of the dacarbazine type; and (7) alkylating agents of the procarbazine type.

48. The method of claim 45, wherein the anticancer agent is selected from the group consisting of chlormethine, chlorambucile, melphalan, uramustine, maimomustine, extramustinephoshate, mechlore-thaminoxide, cyclophosphamide, ifosfamide, trifosfamide, tretamine, thiotepa, triaziquone, mitomycine, busulfan, piposulfan, piposulfam, carmustine, lomustine, semustine, streptozotocine.

49. The method of claim 45, wherein the anticancer agent is selected from the group consisting of: (1) folic acid analogs; (2) pyrimidine analogs; and (3) purine derivatives.

50. The method of claim 45, wherein the anticancer agent is selected from the group consisting of methotrexate, fluorouracil, floxuridine, tegafur, cytarabine, idoxuridine, flucytosine, mercaptopurine, thioguanine, azathioprine, tiamiprine, vidarabine, pentostatin, and puromycine.

51. The method of claim 45, wherein the anticancer agent is selected from the group consisting of vinca alkaloids, epipodophylotoxins, antibiotics, enzymes, biological response modifiers, camptothecin, taxol, and retinoids.

52. The method of claim 45, wherein the anticancer agent is selected from the group consisting of vinblastine, vincristine, etoposide, teniposide, adriamycine, daunomycine, doctinomycin, daunorubicin, doxorubicin, mithramycin, bleomycin, mitomycin, L-asparaginase, alpha-interferon and retinoic acid.

53. The method of claim 45, wherein the anticancer agent is selected from the group consisting of adrenocorticosteroids, progestins, estrogens, antiestrogens, androgens, antiandrogens, and gonadotropin-releasing hormone analogs.

54. The method of claim 45, wherein the anticancer agent is selected from the group consisting of prednisone, hydroxyprogesterone caproate, medroxyprogesterone acetate, megestrol acetate, diethylstilbestrol, ethinyl estradiol, tamoxifen, testosterone propionate, fluoxymesterone, flutamide, and leuprolide.

55. The method of claim 45, wherein the anticancer agent is selected from the group consisting of radiosensitizers, platinum coordination complexes, anthracenediones, substituted ureas, adrenocortical suppressants, and an immunosuppressive drug.

56. The method of claim 40, wherein the attrition media has a particle size selected from the group consisting of: (1) a mixture of about 50 microns and about 200 microns; (2) a mixture of about 50 microns and about 500 microns; (3) a mixture of about 50 microns, about 200 microns, and about 500 microns; (4) no greater than about 500 microns; (5) no greater than about 200 microns; (6) about 50 microns up to about 500 microns; (7) about 500 microns; (8) about 200 microns; and (9) about 50 microns.

57. The method of claim 40, comprising milling the product with the attrition media, wherein the attrition media is polymeric.

58. The method of claim 40, comprising milling the product in the cylindrical vessel, wherein the working volume of the vessel is about 12 mL to about 33 mL.

59. The method of claim 40, wherein the volume of the dispersion is about 5 ml to about 23 mL.

60. The method of claim 40, wherein the volume of the dispersion is less than about 10 mL.

61. The method of claim 40, wherein at the completion of the rotation period, the product has a particle size in the range of microns to nanometers.

62. The method of claim 61, wherein at the completion of the rotation period, the product has a particle size of less than about 500 nm.

63. The method of claim 62, wherein at the completion of the rotation period, the product has a particle size of less than about 400 nm.

64. The method of claim 63, wherein at the completion of the rotation period, the product has a particle size of less than about 300 nm.

65. The method of claim 64, wherein at the completion of the rotation period, the product has a particle size of less than about 100 nm.

66. The method according to claim 40, further including cooling the vessel.

67. The method according to claim 66, wherein the vessel is cooled by jacketing the vessel and flowing water between the jacket and the vessel.

68. The method of claim 40, wherein the method further comprises maintaining substantially uniform shear between the rotor and the and the cylindrical vessel.

69. The method of claim 40, wherein the cylindrical vessel is horizontally orientated when the agitator is inserted into the vessel.

70. The method of claim 40, further including externally circulating the dispersion.

71. The method of claim 40, wherein the predetermined period of rotation of the agitator is a few hours or less.

72. The method of claim 40, further comprising minimizing vortexing during rotation of the agitator.

73. The method of claim 40, further comprising preventing the dispersion formulation from foaming.

74. The method of claim 40, wherein the dispersion is retained in the vessel during rotation of the agitator.

75. The method of claim 40, wherein the dispersion is recirculated through the vessel during rotation of the agitator.

* * * * *